US006314704B1

(12) United States Patent
Bryant

(10) Patent No.: US 6,314,704 B1
(45) Date of Patent: Nov. 13, 2001

(54) COMPOSITE STRUCTURAL BUILDING PANELS AND CONNECTIONS SYSTEMS

(75) Inventor: David Bryant, Reno, NV (US)

(73) Assignee: American Structural Composites, Inc., Sparks, NV (US)

( * ) Notice: Subject to any disclaimer, the term of this patent is extended or adjusted under 35 U.S.C. 154(b) by 0 days.

(21) Appl. No.: 09/569,693

(22) Filed: May 11, 2000

Related U.S. Application Data

(62) Division of application No. 09/169,059, filed on Oct. 9, 1998, now abandoned.

(51) Int. Cl.[7] ..... E04B 2/00

(52) U.S. Cl. ..... 52/745.7; 52/747.1; 52/271; 52/274; 52/284; 52/582.1; 52/586.1

(58) Field of Search ..... 52/92.2, 270, 271, 52/274, 284, 300, 309.1, 747.1, 745.1, 582.1, 582.2, 586.1, 586.2, 585.1, 783.17, 800.1; 403/292, 294

(56) References Cited

U.S. PATENT DOCUMENTS

| | | | | |
|---|---|---|---|---|
| 2,103,894 | * | 12/1937 | Bussmann . | |
| 3,602,110 | * | 8/1971 | Wiggins . | |
| 3,603,049 | * | 9/1971 | Pierce . | |
| 3,771,277 | * | 11/1973 | Rausch et al. | 52/468 |
| 3,823,525 | * | 7/1974 | Brunn . | |
| 4,236,363 | * | 12/1980 | Vinther et al. | 52/285 |
| 4,416,097 | * | 11/1983 | Weir . | |
| 4,644,725 | * | 2/1987 | Schijf | 52/463 |
| 4,726,707 | * | 2/1988 | Newton . | |
| 4,956,953 | * | 9/1990 | Bates . | |
| 5,245,803 | * | 9/1993 | Haag | 52/90.1 |
| 5,272,850 | * | 12/1993 | Mysliwiec et al. | 52/586 |
| 5,274,974 | * | 1/1994 | Haag . | |
| 5,274,975 | * | 1/1994 | Haag | 52/300 |
| 5,274,979 | * | 1/1994 | Tsai | 52/595 |
| 5,305,567 | * | 4/1994 | Wittler | 52/238.1 |
| 5,325,649 | * | 7/1994 | Kajiwara | 52/582 |
| 5,344,700 | * | 9/1994 | McGath et al. . | |
| 5,592,794 | * | 1/1997 | Tundaun | 52/220.7 |
| 5,664,826 | * | 9/1997 | Wilkens | 52/270 X |

FOREIGN PATENT DOCUMENTS

3918676 * 2/1990 (DE) .

* cited by examiner

*Primary Examiner*—Robert Canfield
(74) *Attorney, Agent, or Firm*—Lyon & Lyon LLP

(57) ABSTRACT

A structural building panel including a composite truss member having transverse truss elements defining an undulated shape, and first and second composite skins, formed by a pultrusion process. A composite connector extends along a side edge of the panel, the connector including a tongue and a groove adjacent one another defining an inside face having an elongate aperture therein that extends parallel to the side edge. The connector may slidably engage with a similar connector on an adjacent panel, the tongues and groove interlocking such that the apertures together define a channel through which a rod-like locking member may be received. Composite connection systems are provided for connecting composite wall panels to a foundation and to connect composite roof panels to the wall panels. The connection systems include interlocking connectors having apertures for receiving locking members. A base connector may be bolted to a foundation, wall panels may be placed on the base connector, and a base retaining clip attached to the base connector to secure the wall panels to the base connector. A cap member may be attached to an upper edge of the wall panels, a plurality of roof panels placed on the cap member, and a cap retaining clip attached to secure the roof panels to the wall panels. Corner members including connectors are provided for connecting wall panels at corners of the building structure being erected.

15 Claims, 12 Drawing Sheets

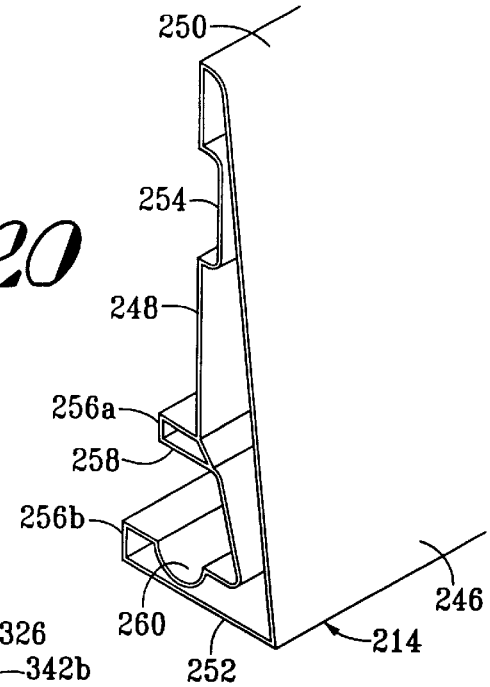
FIG. 20
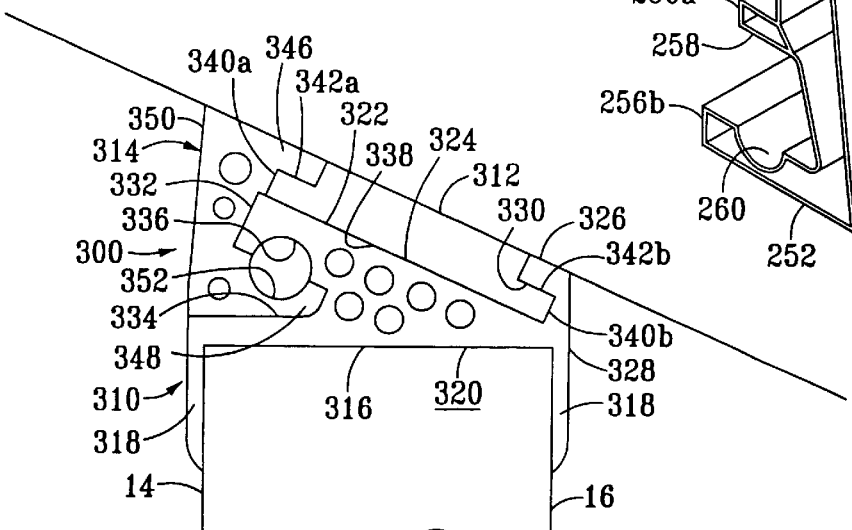
FIG. 21
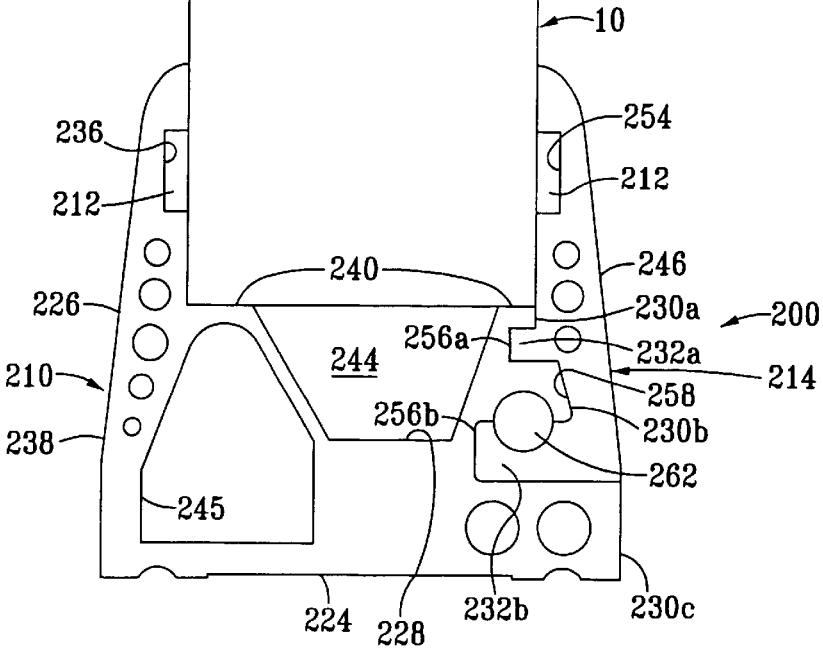

COMPOSITE STRUCTURAL BUILDING PANELS AND CONNECTIONS SYSTEMS

This application is a divisional application of Application Ser. No. 09/169,059, filed on Oct. 9, 1998 now abandoned.

FIELD OF THE INVENTION

The present invention relates generally to structural building components and systems, and more particularly to composite structural building panels, connection systems and related components, and to systems and methods for erecting structures including such panels.

BACKGROUND

Traditionally, housing or other building structures have been erected one component at a time, i.e., they are generally built at the erection site and include structural framework, shear sheathing, vapor barriers, protective exterior siding or finishes, such as paint, and interior finishes or paneling, such as gypsum board. For example, the structural framework may be erected from raw materials, and then other components may be successively added until a finished structure is provided. The various components are generally assembled together using a wide range of fasteners, such as, nails, nuts, bolts, screws, and/or other materials, such as gasketing, adhesives and the like.

Because of the complexity of such structures, highly skilled tradesmen are required, and building them takes substantial time. Further, during construction, ancillary components, such as plumbing, mechanical and electrical systems, architectural features, such as roofing and trim, interior features and the like, may be added to complete the structure. This may further increase labor and time demands, and consequently result in relatively costly building structures.

To reduce field costs and accelerate erection of building structures, factory assembled components have been proposed. For example, prefabricated panels, generally made up of plywood applied over a gypsum board core, may be used to reduce field assembly time. In addition, subassemblies of framing or other structural components may be built in a factory or other offsite environment, where mass production or improved efficiencies may be realized, as compared with field conditions. These components, however, may be bulky, resulting in dramatically increased shipping costs and/or requiring a factory in close proximity to the erection site.

Another problem with conventional building structures is that they often involve the use of wood products, particularly within the residential industry, which are becoming increasingly scarce and expensive. As an alternative, concrete and steel materials may be used, but these materials generally involve heavy equipment and special labor requirements, which may dramatically increase erection time and cost. Further, steel and concrete materials may not adequately resist corrosion and/or may involve complicated seismic load considerations.

More recently, plastic or composite materials, i.e., fiber reinforced plastic ("FRP"), have been considered for panel systems. These panels may simply substitute a composite material for one or more elements of the panels, e.g., the outer skins, while using foam or honeycomb core materials between the skins. Other composite panels have been suggested that use extruded or pultruded composite materials. These panel systems, however, generally still require fasteners, e.g., screws or bolts, in order to connect the panels to specially designed trim components, beams, and the like.

Thus, many of the components necessary to assemble the panels and erect a building structure may be traditional non-composite materials, which may compromise the structural and durability benefits obtained from the use of composite materials.

Other composite systems have suggested tongue and groove or "H" strip connectors between panels, but these systems may also require multiple fasteners to provide a structurally integral connection between the panels. Alternatively, other composite systems may use resin-catalyst mixtures to bond panels together, but these systems may substantially increase erection time, e.g., due to the curing time of panel joints, and/or may involve specially skilled field labor knowledgeable in working with composite materials.

According, there is a need for structural building components and systems that may be assembled in a more efficient manner, and/or that may overcome problems associated with previous systems.

SUMMARY OF THE INVENTION

The present invention is directed to composite building panels and related connection systems, and to methods of assembling and using such panel systems for building structures.

In accordance with one aspect of the present invention, a composite panel for a structural building system is provided that includes a truss member formed from composite material and defining first and second planes spaced apart a predetermined distance from one another. The truss member includes a plurality of truss elements extending substantially transversely between the first and second planes. A first skin formed from composite material extends along the first plane, and a second skin formed from composite material extends along the second plane.

A connector formed from composite material extends along a first edge at least partially defined by the first and second skins. The connector includes an elongate aperture extending generally parallel to the first edge for receiving a locking member therein, whereby the composite panel may be connected to another composite panel having a similar connector and aperture. Preferably, another connector formed from a composite material may be provided that extends along a second edge at least partially defined by the first and second skins, the connector also including an aperture extending generally parallel to the second edge for receiving a locking member therein. More preferably, the connectors are provided on opposite edges from one another, thereby defining side edges of the composite panel.

The truss member preferably includes a first surface element extending along the first plane between adjacent truss elements, and a second surface element extending along the second plane between adjacent truss elements, the second surface element being staggered from the first surface element. More preferably, the truss member includes alternating sets of first and second surface elements extending along the first and second planes, respectively, along a width of the truss member.

In one form, the first skin is bonded to the first surface elements, and/or the second skin is bonded to the second surface elements. The connectors may then be bonded to the side edges between the first and second skins. Alternatively, the connectors may be integrally formed with the truss member. In a further alternative, the truss member, first skin and second skin may be integrally formed together, e.g., during a pultrusion process.

In addition, the composite panel may also include a base insert clip extending along a third edge, preferably a lower edge, at least partially defined by the first and second skins for connecting to a base connector. The composite panel may also include a cap member extending along a fourth edge, preferably an upper edge, for connecting to a roof panel clip.

Thus, in a preferred form, the composite panel includes composite connectors, preferably bonded along each edge of the panel.

In accordance with another aspect of the present invention, a modular composite panel system is provided that includes a truss member, a first skin and a second skin, each formed from composite material. The truss member is a single sheet of material having an undulated shape, thereby defining first and second planes spaced apart a predetermined distance from one another. The truss member includes a plurality of truss elements extending substantially transversely between the first and second planes, first surface elements extending along the first plane between adjacent truss elements, and second surface elements extending along the second plane between adjacent truss elements. The second surface elements alternate with the first surface elements along a width of the truss member.

The first skin is attachable to the truss member along the first plane, and the second skin is attachable to the truss member along the second plane. In a preferred form, the first skin includes an exterior surface having a predetermined architectural finish molded directly into the composite material. For example, the predetermined architectural finish may include a stucco pattern, a brick pattern, a tile pattern, or a wooden panel pattern.

Preferably, the modular composite panel system includes a panel connector formed from a composite material extending along an edge of the truss member. The panel connector may be bonded to at least one of the truss member, the first skin and the second skin. In a preferred form, the panel connector includes a tongue and a groove adjacent one another extending along a length of the panel connector. The tongue and the groove define an inside face therebetween generally parallel to the first plane having an elongate aperture therein for receiving a portion of a locking member, the elongate aperture extending along the length of the panel connector. Preferably, the tongue and the groove have a generally symmetrical shape for cooperatively engaging a similarly shaped tongue and groove connector of an adjacent composite panel.

In addition, the modular composite panel system may include a base connection member formed from composite material. The base connection member generally includes a substantially planar lower surface for engaging a horizontal surface, such as a concrete slab foundation, and a pair of opposing raised portions extending along a length of the base connection member for securely engaging a lower portion of an assembled panel assembled from the truss member and the first and second skins. In one form, the raised portions and the first and second skins may include cooperating recesses and tabs for securing the assembled panel in a channel in the base connection member. In another form, a base insert clip extends from the lower portion of the panel member. The base insert clip and raised portions of the base connection member may include cooperating notches for securing the panel member to the base connection member.

In addition, one of the raised portions may be a base retaining clip that is detachable from a base connector defining the other raised portion. The base retaining clip and the base connector may include interlocking tongues and grooves, and preferably include cooperating elongate apertures extending along their lengths for receiving a locking member therein, similar to the locking member described above. The base connection member may also include an elongate trough and/or one or more substantially enclosed passages extending along the length of the base connection member.

The modular composite panel system may also include a cap member including a pair of opposing legs defining a channel therebetween, the channel having a width similar to the predetermined distance between the first and second planes of the truss member, i.e., corresponding to the thickness of the assembled panel. The cap member includes an inclined surface opposite the pair of opposing legs, the inclined surface having a predetermined slope corresponding to a desired roof grade.

A composite roof panel may be attachable substantially transversely to an upper edge of the assembled panel, the roof panel including a composite truss member, and composite first and second skins, similar to the panel member described above. A composite roof connection system may be provided for connecting the roof panel to the assembled panel. The roof connection system preferably includes the cap member described above, and a cap retaining clip for engaging the cap member and the roof panel.

The roof panel and the cap member may include one or more cooperating tabs and recesses for connecting the roof panel to the cap member. More preferably, the roof panel includes a composite roof panel clip integrally molded or bonded to a predetermined location on the roof panel. When the roof panel is placed on the cap member, flanges on the roof panel clip and cap member preferably interlock. The cap retaining clip may then be connected to the interlocked roof panel clip and cap member. Preferably, the cap retaining clip and cap member include cooperating elongate apertures extending along their lengths for receiving a locking member therein, thereby substantially securing the roof panel to the assembled panel.

In accordance with another aspect of the present invention, an interlocking composite panel system for a building structure is provided that includes a substantially planar first panel member formed from composite material, and having inner and outer surfaces spaced apart a predetermined distance from one another. A first connector extends along a first edge of the first panel member, the connector generally having an "L" shape defining an inside face extending substantially parallel to the inner and outer skins, the inside face having an elongate aperture therein extending parallel to the first edge.

In addition, the interlocking panel system may also include a substantially planar second panel member formed from composite material, and having inner and outer surfaces spaced apart the predetermined distance from one another. A second connector may extend along a second edge of the second panel member, the second connector generally having an "L" shape defining an inside face extending substantially parallel to the inner and outer skins, the inside face having an elongate aperture therein extending parallel to the second edge. The first and second connectors preferably interlock when the first and second panel members are abutted together in a substantially planar orientation along the first and second edges such that the elongate apertures together define a channel for receiving a locking member therethrough. An elongate locking member may be received through the channel defined by the elongate apertures in the first and second connectors, thereby substantially securing the first and second panel members together.

Preferably, the first connector is formed from composite material, and is bonded to the first panel member along the first edge. More preferably, another connector may be provided along a third edge of the first panel member opposite the first edge. This connector may also generally have an "L" shape defining an inside face extending generally parallel to the inner and outer skins, the inside face having an elongate aperture therein extending substantially parallel to the third edge.

In accordance with still another aspect of the present invention, a method is provided for assembling a composite panel. The composite panel may be provided from a composite truss core member defining first and second planar surfaces, a composite first skin, a composite second skin, and a composite connector. The truss core member may be mounted in an assembly fixture, and the first skin may be bonded to the truss core member along the first planar surface. The truss core member may be inverted, and the second skin bonded to the truss core member along the second planar surface. The connector may be bonded along an edge of the truss core member. Preferably, the first and second skins overlie the edge of the truss core member, thereby defining a recess into which the connector may be received and bonded.

More preferably, a pair of panel connectors are provided, which are bonded onto opposing side edges of the truss core member. A base insert clip may also be bonded along a lower edge of the truss core member, preferably within another recess defined by the first and second skins. A cap member may also be bonded along an upper edge, the cap member preferably including opposing legs defining a channel within which the upper edge may be received and bonded.

In accordance with another aspect of the present invention, a method is provided for assembling a building structure from a plurality of composite panel members having panel connectors extending along their side edges. The panel connectors include an elongate aperture extending generally parallel to the side edges of the respective panel members. First and second panel members may be placed in a generally planar orientation with respect to one another. The panel connectors of the first and second panel members may be interlocked such that the elongate apertures of the panel connectors together define a channel extending between the first and second panel members. A locking member may be inserted through the channel, thereby substantially locking the first and second panel members together.

A composite base connection member may be attached to a substantially horizontal substrate, the base connection member including a pair of raised portions extending along its length. A lower edge of the first panel member may be engaged by the raised portions to retain the first panel member in a substantially vertical orientation.

In a preferred form, a composite base insert clip may extend along, and preferably be bonded to, the lower edge of the first panel member, the base insert clip including a pair of notched clip portions for engaging notches on the raised portions of the base connection member. The base connection member may include a base connector including a first raised portion, and an attachable base retaining clip including a second raised portion. The first panel member (or a plurality of panel members) may be placed on the first raised portion, such that the notches on the first raised portion substantially engage one of the notched clip portions on the first panel member. The base retaining clip may be attached to the base connector, the notches on the second raised portion substantially engaging the other notched clip portion, thereby holding the first panel member substantially vertically. The base connector and base retaining clip preferably include cooperating elongate apertures within which a locking member may be inserted, thereby substantially locking the first panel member to the base connection system.

In an alternative form, the raised portions define a channel between them, and the lower edge of the first panel is placed in the channel. The base connection member may include a base connector including a first raised portion, and an attachable base retaining clip including a second raised portion. The lower edge of the first panel member may be placed on the base connector with a first skin of the first panel member against the first raised portion. The base retaining clip may be attached to the base connector such that the second raised portion substantially engages a second skin of the first panel member. Preferably, the raised portions and the first and second skins of the first panel member include cooperating tabs and slots for substantially securing the first panel member within the channel. The base connector and base retaining clip also preferably include cooperating elongate apertures that together define a channel for receiving a locking member, similar to the connection systems described above.

Utility accessories, such as electrical wiring or conduit and plumbing materials, may be directed along a passage within the base connector member. For example, the raised portion may define a trough therebetween which provides a substantially enclosed passage when the panel member is secured to the raised portions. Alternatively, one or more substantially enclosed passages may be molded directly within the profile of the base connection member, for example, to accommodate electrical or plumbing systems.

In addition, a composite cap member may be attached, e.g. bonded, to an upper edge of the first panel member. A third panel member may then be attached to the cap member in a substantially transverse orientation with respect to the first panel member. Preferably, the third panel member and the cap member include one or more cooperating tabs and recesses for retaining the third panel member thereon. The cap member also preferably includes an inclined upper surface, whereby when the third panel member is attached to the upper surface, a desired roof grade may be provided.

A cap retaining clip may be attached to the cap member for securing the third panel to the cap member. In a preferred form, the cap member and the cap retaining clip include elongate apertures extending along their lengths. The cap retaining clip may be aligned with the cap member such that the apertures define a channel extending between the cap retaining clip and the cap member. A locking member may be inserted through the channel, thereby substantially locking the cap retaining clip to the cap member, similar to the embodiments described above.

A composite corner member may also be provided that has first and second panel connectors extending along its length. Each panel connector includes an aperture extending generally parallel to the length of the corner member, and the first panel connector may be oriented substantially transversely, and preferably substantially perpendicular, to the second panel connector. A panel connector of the first panel member may be interlocked with the first panel connector of the corner member such that the apertures of the panel connectors together define a channel extending between the first panel member and the corner member. A panel connector of a third panel member may be interlocked with the second panel connector of the corner member such that the apertures of the panel connectors together define a channel extending between the third panel member and the corner member. Locking members may then be inserted through each channel, thereby substantially locking the first and third panel members to the corner member.

The systems and methods in accordance with the present invention may be well suited to provide a relatively inexpensive alternative to traditional building structures. The composite panels and connection systems may substantially accelerate erection times, yet may result in building structures that are more durable than traditional structures. The components may be initially manufactured under automated and/or large scale conditions, thereby substantially reducing manufacturing costs. Similar components may be nested together to minimize shipping costs, and the panels may then be assembled at or near the erection site.

Another important feature is that the design of the panels and connection systems may be optimized to provide a structure capable of resisting predetermined load conditions, such as known wind or seismic loads, likely to be encountered during the life of the structure at a known location. The panels and connections systems may also provide their own architectural finish elements, possibly eliminating expensive subsequent finishing, and/or they may accommodate ancillary systems, such as plumbing and electrical systems.

Other objects and features of the present invention will become apparent from consideration of the following description taken in conjunction with the accompanying drawings.

BRIEF DESCRIPTION OF THE DRAWINGS

FIGS. 18–20 are perspective views of an alternate embodiment of a base connection system.

FIG. 21 is a cross-sectional view of a composite panel connected to base connection system and roof connection systems.

DETAILED DESCRIPTION OF THE PREFERRED EMBODIMENTS

Figure 1A:
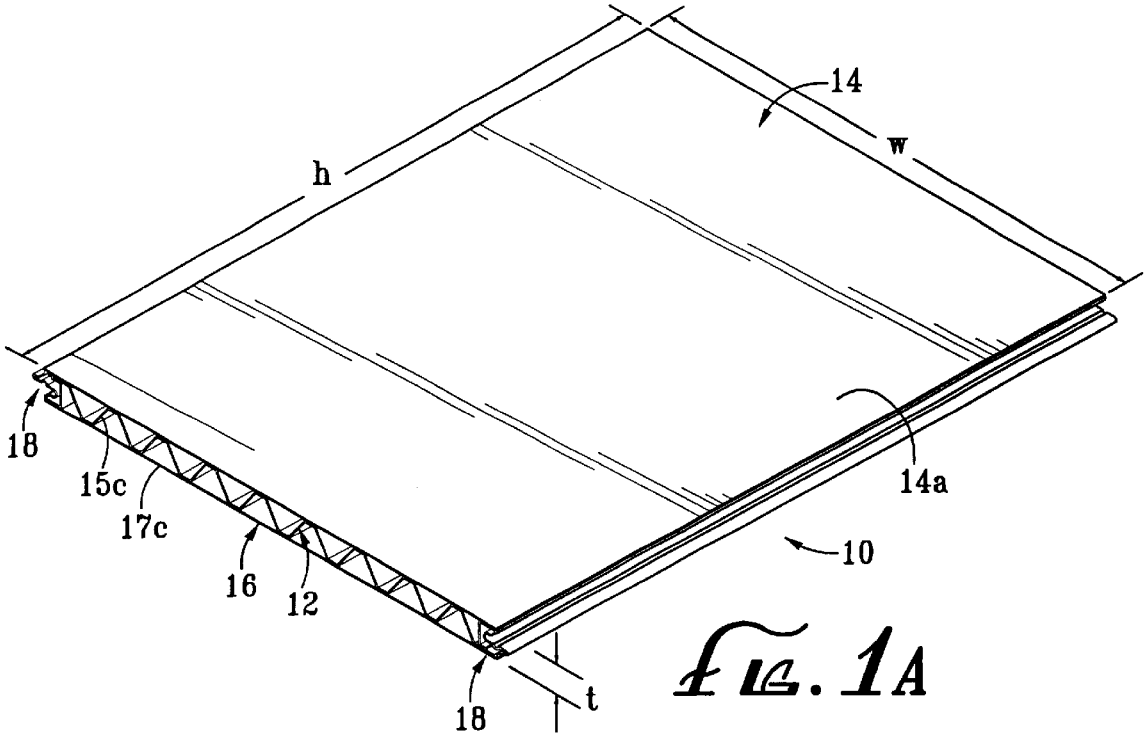
FIG. 1A is a perspective view of an assembled composite panel, in accordance with the present invention.
Figure 1B:
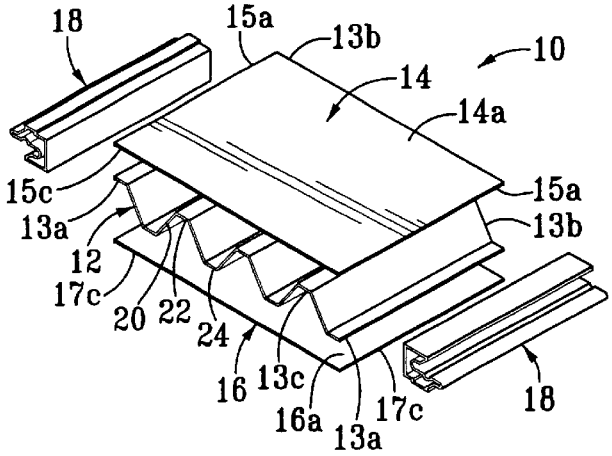
FIG. 1B is an exploded perspective view of the composite panel of FIG. 1, showing the component making up the panel.

Turning now to the drawings, FIGS. 1A and 1B show a preferred embodiment of a panel member 10 in accordance with one aspect of the present invention. The panel member 10 is formed entirely from "composite" materials, i.e., from a fiber material impregnated within a resin, also commonly referred to as fiber reinforced plastic or "FRP," as described further below. The panel member 10 generally includes a truss member 12, an outer or first skin 14, an inner or second skin 16, and a pair of panel connectors 18. The truss member 12 is preferably formed from a single sheet of composite material having a generally undulated shape. More particularly, the truss member 12 includes a plurality of truss elements 20 extending substantially transversely between alternating sets of first and second surface elements 22, 24 extending along first and second planes, respectively, preferably along a width of the truss member 12.

The first and second skins 14, 16 are formed from a sheet of composite material having a predetermined thickness, and defining a generally planar surface including a width "w" and a height "h." Preferably, the width w is slightly wider than the width of the truss member 12 to accommodate the attachment of the panel connectors 18, as explained further below. The outward facing surface 14a of the first skin 14 may include a predetermined architectural finish molded directly into the composite material, as may the outward facing surface (not shown) of the second skin 16. For example, a stucco pattern, a brick pattern, a tile pattern, a wooden panel pattern, and the like may be provided, thereby eliminating the need for subsequent architectural finishes once the panel member 10 is incorporated into a building structure, as explained further below.

Figure 2A:
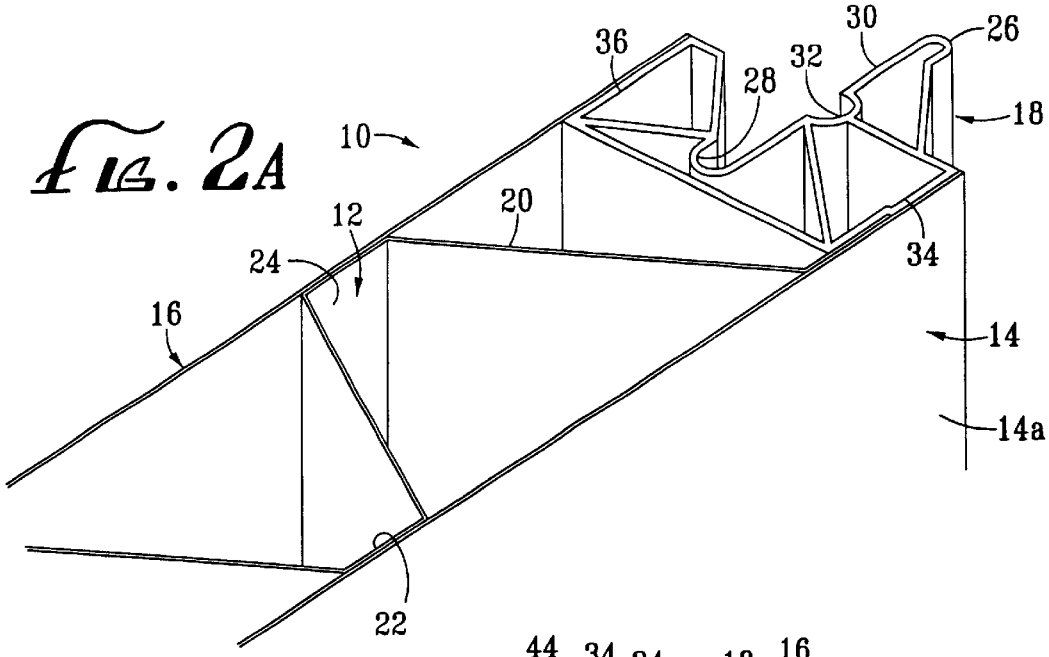
FIG. 2A is a perspective view of an upper corner of the composite panel of FIG. 1A, showing a panel connection the composite panel.
Figure 2B:
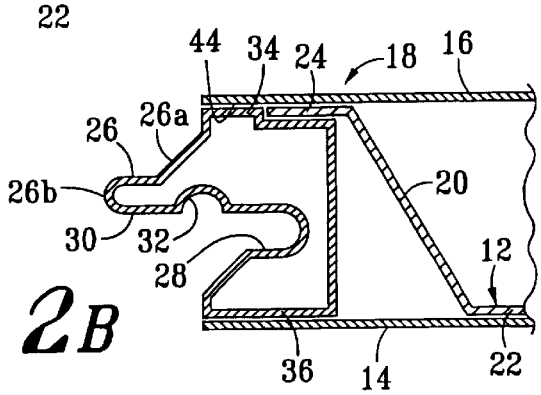
FIGS. 2B–2D are alternate end view details of the panel connector of FIG. 2A.

Turning to FIGS. 2A and 2B, each panel connector 18 is formed from composite material and generally includes a tongue 26 and a similarly shaped groove 28 extending along a length of the panel connector 18, and preferably configured adjacent one another to generally define an "L" shape. The tongue 26 and groove 28 define an inside face 30 between them having an elongate aperture or groove 32 therein. Preferably, the inside face 30 extends substantially parallel to first and second side surfaces 34, 36 of the panel connector 18 to facilitate attachment between panel connectors on adjacent panel members in a generally planar orientation, as explained further below. The aperture 32 preferably has a generally hemispherical cross-section, although other alternative cross-sections may also be provided, such as square, rectangular or other radially symmetrical shapes. Further, the aperture 32 is preferably provided at a midpoint of the inside face 30, or in some other symmetrical manner.

Figure 3:
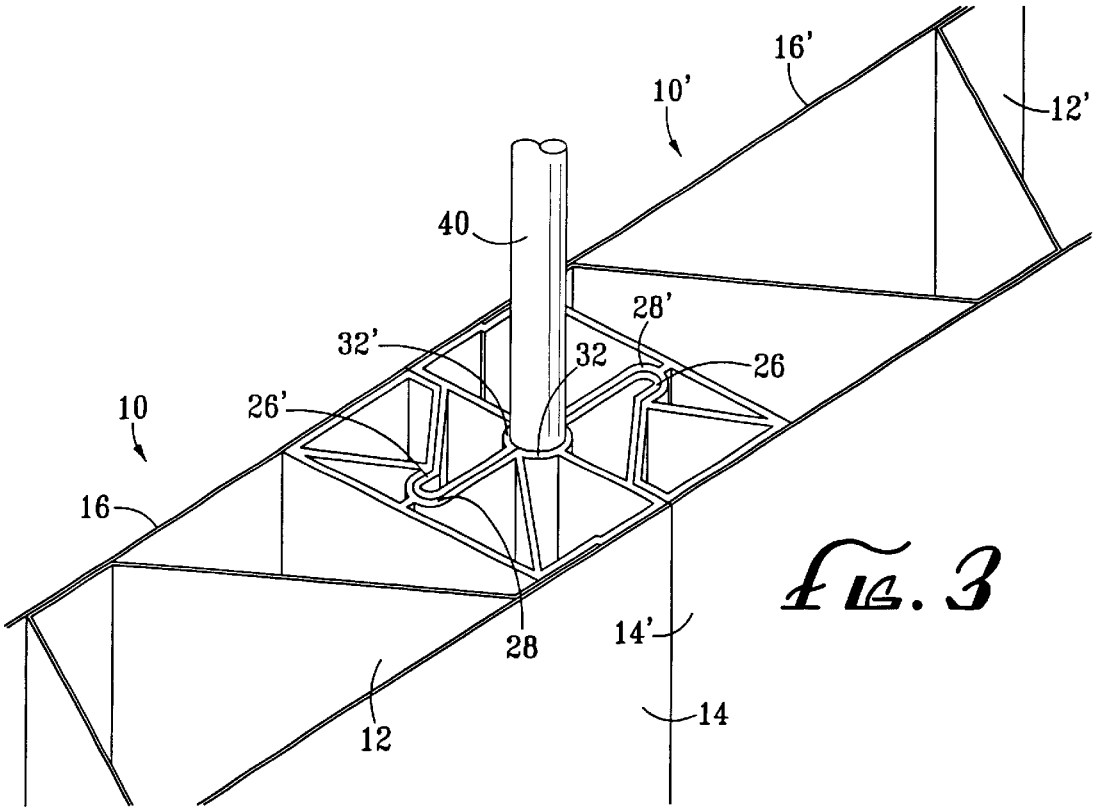
FIG. 3 is a perspective view of the upper corner of FIG. 2A, with the panel connector being attached to a similar panel connector of an adjacent composite panel.

As shown in FIG. 3, the panel connector 18 is configured to slidably interlock within a similar panel connector 18' provided on another panel member 10'. The panel members 10, 10' may be aligned in a substantially planar configuration with respect to one another, and then abutted together such that the tongues 26, 26' are received in and substantially engage the grooves 28', 28, respectively, of the respective panel connector 18', 18. As this occurs, the apertures 32, 32' are aligned with one another to together define a channel extending between and along the length of the panel members 10, 10'.

A rod-like locking member 40 may then be directed into the channel, thereby substantially locking the two panel members 10, 10' together. Once the locking member 40 is fully received through the channel, the panel connectors 18, 18' may not be separated because of the unique configuration of the apertures 32, 32' and the tongues 26, 26' and grooves 28, 28'. Thus, adjacent panel members 10, 10' may be joined together without the need for other fasteners, such as bolts, screws or bonding materials.

In a preferred form, the locking member 40 is a solid generally cylindrical rod, preferably formed from metal or composite material, such as steel, that may be relatively inexpensive and may have desired structural characteristics. The channel defined by the apertures 32, 32' preferably has a similar generally cylindrical cross-section as the locking member 40 to provide a slidable interference fit. Alternatively, the locking member 40 may be a hollow tubular member having predetermined structural characteristics. In further alternatives, the apertures 32, 32' may have other cross-sections to provide other predetermined substantially symmetrical shapes for the channel (not shown), and the locking member (not shown) may then have a similar shape to facilitate attaching the panel members together.

Returning to FIGS. 1A and 1B, the panel member 10 is preferably manufactured from separate components, which may nest together with other like components. For example, it may be desirable to manufacture the components for a system of panels at a manufacturing site, ship the components to a remote location, such as an erection site, or a pre-assembly facility in close proximity to the erection site. The components may then be assembled, e.g., bonded, into panels, which may then be erected into a building structure, as described further below. Because the separate components may be more efficiently nested than the fully assembled panels, costs related to shipping and handling of the panels may be substantially reduced, particularly when the panels are being shipped substantial distances, such as overseas.

To assemble a panel member 10, a resin-catalyst mixture may be used, having a similar composition to the resin used to manufacture the panel components themselves, such as a phenolic resin, as will be appreciated by those skilled in the art. The truss member 12 may be placed in a predetermined orientation, e.g., horizontally on an assembly fixture or table. Resin-catalyst mixture may be applied, e.g. brushed or sprayed, onto the first surface elements 22 of the truss member 12 and/or onto the inner surface (not shown) of the first skin 14, and the first skin 14 placed against the first surface elements 22 of the truss member 12. Before the resin-catalyst sets, the first skin 14 may be aligned with the truss member 12, e.g., aligning their upper edges 13*b*, 15*b*, their lower edges 13*c*, 15*c* and/or their side edges 13*a*, 15*a* in a predetermined orientation. Preferably, the side edges 15*a* of the first skin 14 extend substantially evenly over each side edge 13*a* of the truss member 12 a predetermined distance.

Once the resin-catalyst mixture has been allowed sufficient time to set-up, the truss member 12 may be inverted within the fixture or otherwise turned over to expose the second surface elements 24 of the truss member 12, e.g., such that the first skin 14 is beneath the truss member 12. Resin-catalyst mixture may then be applied onto the second surface elements 24 of the truss member 12 and/or onto the inner surface 16a of the second skin 16, and the second skin 16 placed against and aligned with the truss member 12.

As shown in FIG. 1A, once the first and second skins 14, 16 are successively bonded onto the truss member 12, the resulting panel member 10 has a predetermined thickness "t" set by the height of the truss elements 20 and the thickness of the first and second skins 14, 16. These dimensions may at least partially set the structural characteristics of the panel member, but may be modified to meet the structural needs of a particular building structure, thereby by providing flexibility and optimization in panel design, and consequently in structural building design. For example, additional structural strength may be added generally by increasing the thickness of the skins 14, 16 and/or increasing the height or number of the truss elements 20. In a preferred form, the panel member 10 has a finished thickness of about 4.5 inches, thereby facilitating the incorporation of standard architectural accessories, e.g., standard door and window frames, into the panel member 10.

The height h of the panel member 10 may be determined by desired architectural configurations, such as ceiling height, roof pitch, and/or other dimensions of a building structure erected from the panel member 10 and other similar panels. The width w, however, may be selected based upon a number of factors, including ease of handling, size and space of manufacturing equipment, and/or structural characteristics of the panel member 10. Because composite materials are relatively light as compared to other building materials, relatively large panel widths may be designed which may still provide a desired structural integrity, yet be handled and/or erected without the need for special equipment.

For example, a panel member 10 having a width w of about six feet may provide a useful and convenient standardized width. Such a panel member 10 may accommodate the integration of relatively wide architectural features, such as standard five foot wide windows (not shown), without significantly affecting the structural integrity of the panel member 10. A panel member 10 about six feet wide may also weigh only about 120 pounds, and so may be handled by as few as two adults without the aid of special equipment.

The panel connectors 18 may then be bonded or otherwise attached to the panel member 10, preferably along opposite side edges 15*a*. For example, as shown in FIG. 2B, the first and second skins 14, 16 may extend up to about 1.5 inches beyond the side edges 13*a* of the truss member 12, thereby defining a recess 44 into which the panel connectors 18 may be received and bonded. Thus, resin-catalyst mixture may be applied to the side surfaces 34, 36 of the panel connectors 18 and/or the inner surfaces of the first and second skins 14, 16. The panel connectors 18 may be inserted into the recess 44, and the resin allowed to cure.

Figure 2C:
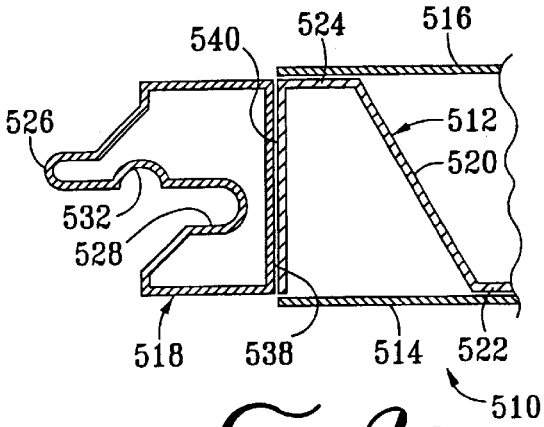

In a preferred form, the side edges 13*a* of the truss member 12 are simply bonded to one of the first and second skins 14, 16, e.g., by a final first or second surface element 22, 24 on the truss member 12, as shown in FIG. 2B. Alternatively, as shown in FIG. 2C, a truss member 512 may be provided that includes an end plate 540 extending substantially perpendicularly between the first and second skins 14, 16. The width of the truss member 512 may be the same as the width w of the first and second skins 514, 516. A panel connector 518 may then be bonded to the end plate 540. Alternatively, the inner and outer skins 514, 516 may extend beyond the end plate 540 (not shown), the end plate 540 thereby further defining a recess (not shown) into which the panel connector 518 may be bonded. Resin-catalyst mixture may be applied to the end plate 540 and/or to a back surface 538 of the panel connector 518 to further bond the panel connector 518 to the panel member 510.

Figure 2D:
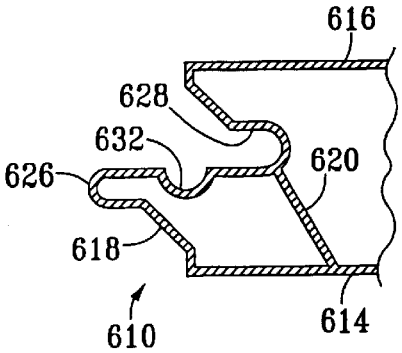

In a further alternative, shown in FIG. 2D, a panel member 610 may be molded from a single profile of composite material, for example, using a pultrusion process. The truss elements 620 may be integrally molded to and extend substantially transversely between inner and outer skins 614, 616. The panel connectors 618 may also be integrally molded between the inner and outer skins 614, 616. Unlike the assembled panel member 10 of FIG. 2B, the integral panel member 610 may have greater resistance to delamination. Delamination may occur, for example, when the panels are subjected to substantial load conditions, which may exceed the yield strength of the panels, and particularly their bonded joints, and/or if the skins are not properly bonded to the underlying truss member during manufacturing.

In another aspect of the present invention, a system for erecting a building structure is provided that includes a number of connection systems for creating a building structure using composite panels, such as the panel members described above. For example, turning to FIGS. 4–8, a base connection system 100 is shown for connecting wall panels to a concrete slab, a raised foundation or other substantially horizontal substrate (not shown). Generally, the base connection system 100 includes a base connector 110, a base insert clip 112, and a base retaining clip 114, all formed from composite material.

Figure 4:
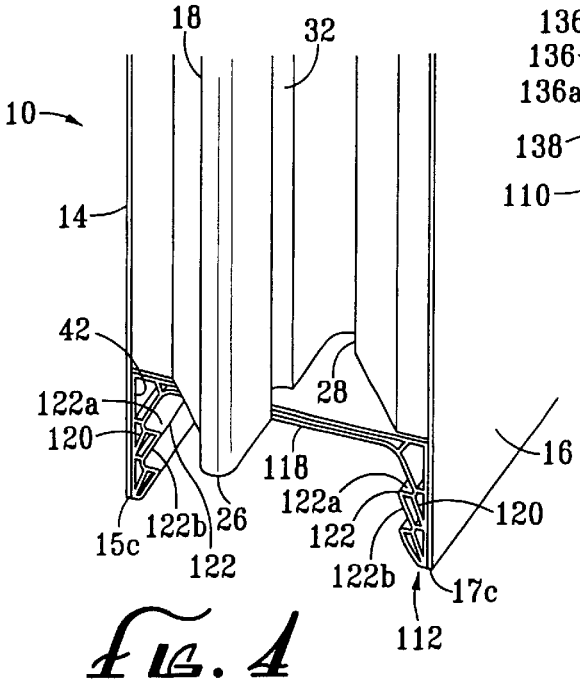
FIGS. 4–7 are perspective views of a lower corner of the composite panel of FIG. 1A, showing a base connection system for connecting the composite panel to a base connector.

With particular reference to FIG. 4, the base insert clip 112 is an elongate generally "C" shaped member including two opposing clip portions 116 extending from a back portion 118. Each clip portion 116 defines a substantially flat outer surface 120, and includes a plurality of notches 122 defining substantially blunt upper edges 122*a* and generally tapered lower edges 122*b*. The clip portions 116 are separated from one another a predetermined distance corresponding generally to the thickness of the panel member 10. Thus, the base insert clip 112 may be received between the inner and outer skins 14, 16 of the panel member 10, preferably such that the clip portions 116 are generally flush with the lower edges 15*c*, 17*c* of the inner and outer skins 14, 16.

The base insert clip 112 may be bonded or otherwise attached to the panel member 10, preferably when the panel member 10 is initially manufactured, or alternatively when the panels are pre-assembled from their components. Preferably, the height of the first and second skins 14, 16 is longer by a predetermined distance than the height of the truss member 12 (not shown) and the length of the panel connectors 18 such that a channel 42 is provided along the panel member 10 into which the base insert clip 112 may be received and bonded. The base insert clip 12 may be cut from a longer section into a length corresponding to the length of the panel member 10, and resin-catalyst mixture may be applied to the outer surfaces 120 of the clip portions 16 and/or to the inner and outer skins 14, 16 within the channel 42. Once the applied mixture has cured, the base insert clip 112 may be substantially permanently bonded to the panel member 10.

Figure 5:
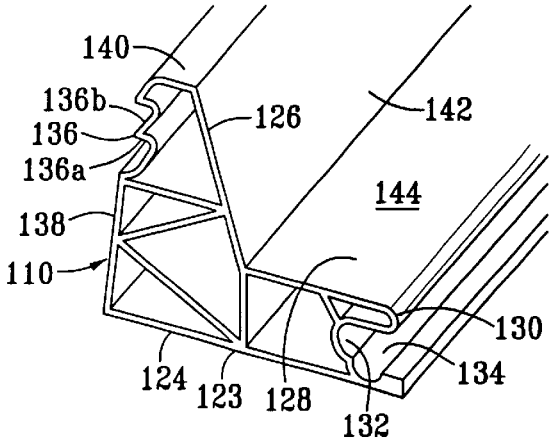
Figure 6:
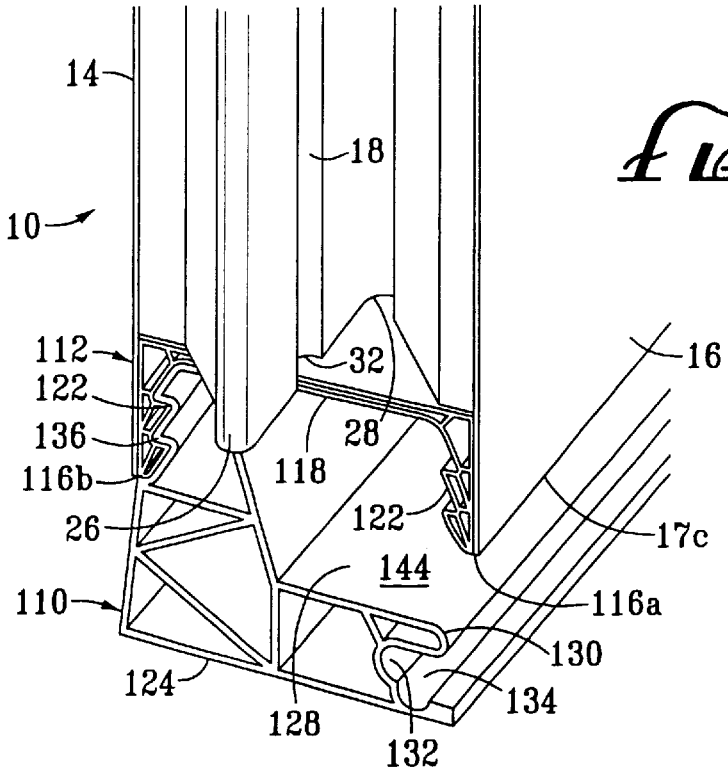

Turning to FIG. 5, the base connector 110 is an elongate generally "L" shaped member having a lower portion 123 defining upper and lower surfaces 128, 124, and a raised portion 126. A plurality of notches 136 are provided in an outer surface 138 of the raised portion 126, each notch 136 having a substantially blunt lower edge 136*a* and a generally tapered upper edge 136*b*. As shown in FIG. 6, the notches 136 on the base connector 110 have a shape similar to the notches 122 on the clip portions 116 of the base insert clip 114. The raised portion 126 also has an inner surface 140 which, together with the upper surface 128 of the lower portion, at least partially defines a passage 144, described further below. Opposite the raised portion 126, the lower portion 123 includes a tongue 130 and a groove 132 adjacent one another, the groove 132 including a generally hemispherical aperture 134 therein extending along the length of the base connector 110.

Figure 7:
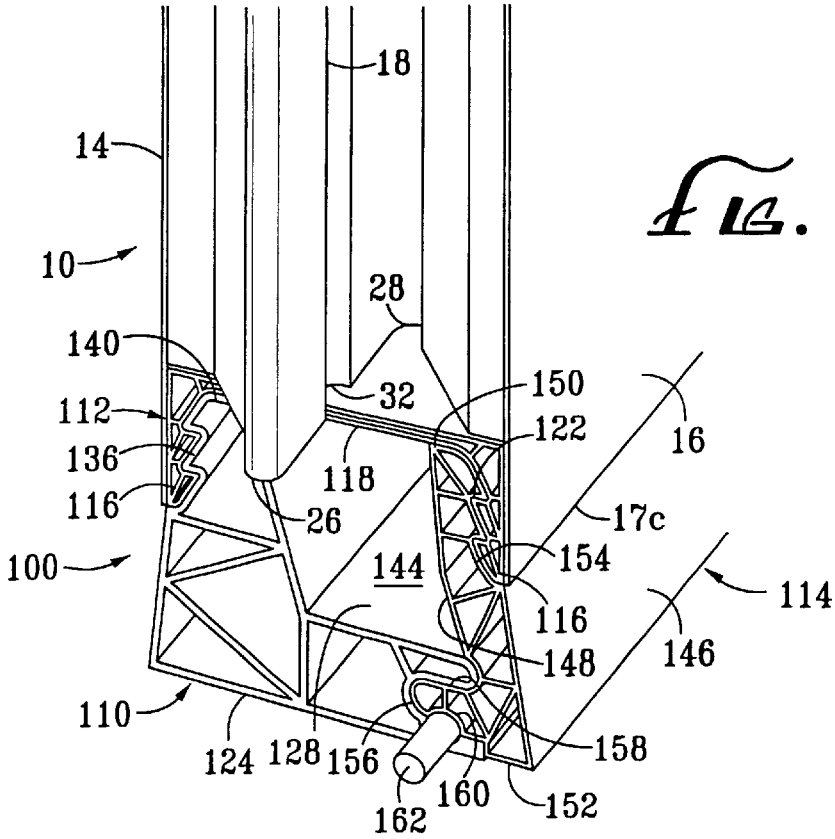
Figure 8:
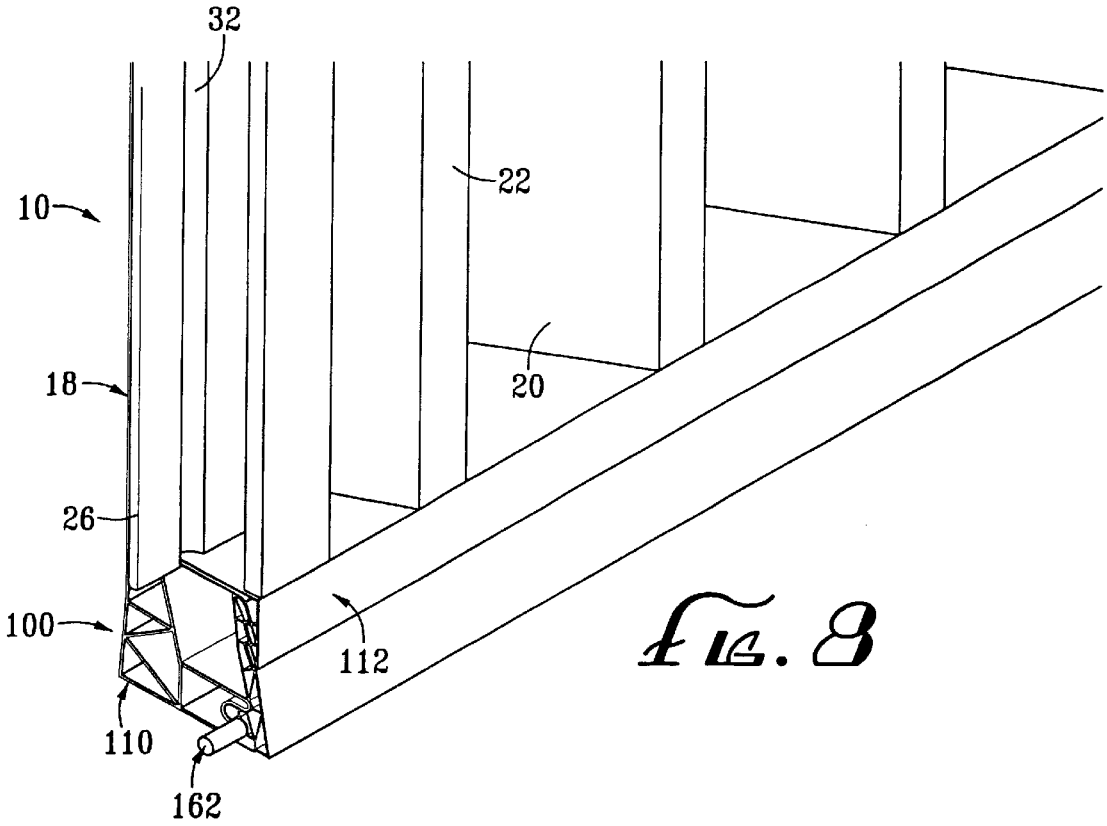
FIG. 8 is a perspective view of a composite panel connected to a base connector, with one of its skins removed to expose an internal truss core.

Turning to FIG. 7, the base retaining clip 114 is an elongate generally "L" shaped member including inner and outer surfaces 148, 146, and upper and lower surfaces 150, 152. A plurality of notches 154 are provided in the outer surface 146, similar to the notches 136 provided in the raised portion 126 of the base connector 110. The inner surface 148 includes a tongue 156 and a groove 158, the tongue 156 including a hemispherical aperture 160 therein, similar to the aperture 134 in the base connector 110.

During erection of a building structure composed of a plurality of composite wall panels, such as the panel member 10, the base connector 110 may be attached to a horizontal substrate (not shown) already prepared at the site of erection. For example, a plurality of bolts or other fasteners (not shown) may be driven through the lower portion 123 of the base connector 110, e.g., into the upper surface 128 of the base connector 110 and through the lower surface 128 into the substrate. The bolts may be spaced a predetermined distance along the length of the base connector 110, for example, at between about one and four foot intervals, to substantially anchor the base connection system 100, as will be appreciated by those skilled in the art. Alternatively, an adhesive may be applied between the lower surface 124 and the substrate to bond the base connector 110 and/or a sealing compound may be applied to provide a fluid-tight seal between the base connector 110 and the substrate.

As shown in FIG. 6, a number of wall panels, such as the panel member 10, may then be placed onto the base connector 110 such that the notches 136 on the base insert clip 112 cooperate and substantially engage the notches 136 on the base connector 110. The back portion 118 of the base insert clip 112 may further define the passage 144, thereby providing a space beneath the wall panels through which electrical conduit, individual wires or cables, plumbing or other fluid conduits, and the like may be run along the wall of the building structure. Temporary clips or spacers (not shown) may be provided between the clip portion 116*a* and the base connector 110 and/or the substrate itself to temporarily support the wall panels during erection of the wall and/or to provide access to the passage 144.

Turning to FIG. 7, subsequent to the removal of any interfering temporary clips, the base retaining clip 114 may then be attached to the base connector 110. The upper surface 150 of the base retaining clip 114 may be inserted into the passage 144 with the notches 154 oriented towards the notches 122 on the clip portion 166 of the base insert clip 112. The tongue 156 on the base retaining clip 114 may be directed into the groove 132 in the base connector 110, causing the tongue 130 on the base connector 110 to be received in the groove 158 in the base retaining clip 114. Simultaneously, the notches 146 on the base retaining clip 114 substantially cooperate with the corresponding notches 122 on the base insertion clip 112.

As the tongues 156, 130 and grooves 132, 158 substantially interlock, the apertures 134, 160 together define a substantially cylindrical channel between the base connector 110 and the base retaining clip 114 and extending along their lengths. A locking member 162, similar to those described above, may be driven through the channel, thereby substantially locking the base retaining clip 114 to the base connector 110. The locking member 162 may have a length corresponding to the width of the individual panel member 10, but preferably has a length substantially longer than a single panel, thereby locking multiple wall panels together to the base connection system 100.

With the panel member 10 substantially secured to the base connection system 100, the panel member 10 may be supported by the upper surface 140 of the raised portion 126 of the base connector 110 and the upper surface 150 of the base retaining clip 114, thereby retaining the panel member 10 in a substantially vertical orientation. The engagement of the notches 122, 136, 154 may provide further support of the panel member 10, for example, against shear forces, such as wind.

The base connection system 100 may also provide a passage 144 beneath the panel member 10 that may be substantially isolated and/or sealed from external elements. Thus, ancillary components, such as electrical or plumbing systems, may be directed through the passage 144 and protected from exposure to moisture and other elements. If desired, other substantially enclosed passages (not shown) may be provided within the base connection system 100 to accommodate ancillary components, or to provide a fluid conduit if properly sealed.

For example, it may be desirable to direct electrical wiring (not shown) along a passage in the base connection system 100 after erection of one or more wall panels, but prior to the attachment of the associated base retaining clip 114. Electrical outlets, switches and the like may be preinserted into the wall panels during initial manufacturing or during subsequent assembly, or alternatively installed prior to erection of respective individual panels. Wiring from the outlet may be directed down between the truss elements of the wall panel, a hole may be cut through the back portion 118 of the base insert clip 112, and the wiring directed through the hole. When the panel is erected in place, the wiring from the outlet may then be coupled to the wiring extending along the passage 144, which may facilitate installation of electrical systems.

Figure 18:
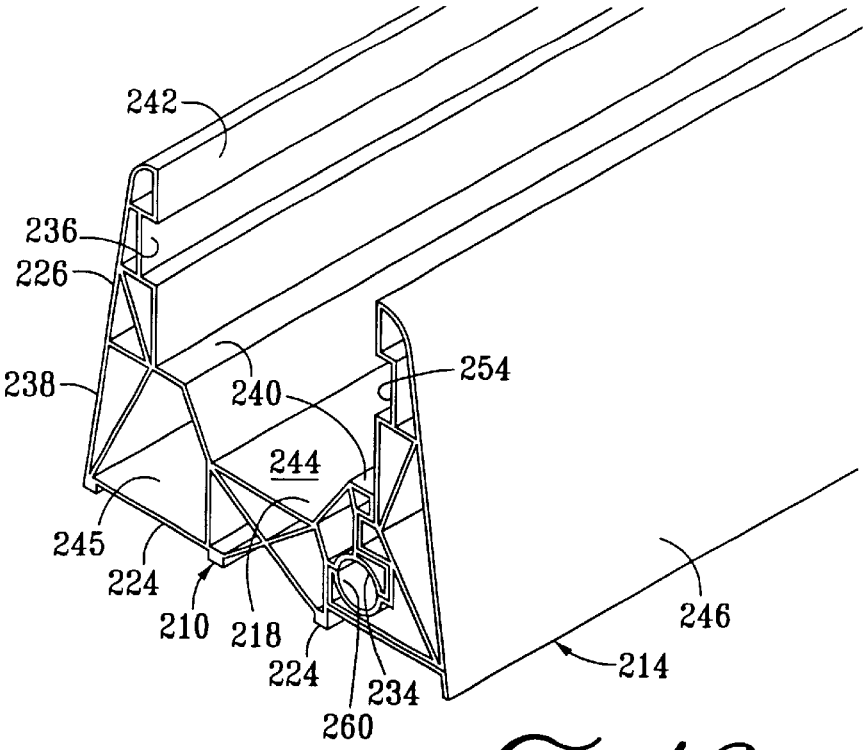
Figure 19:
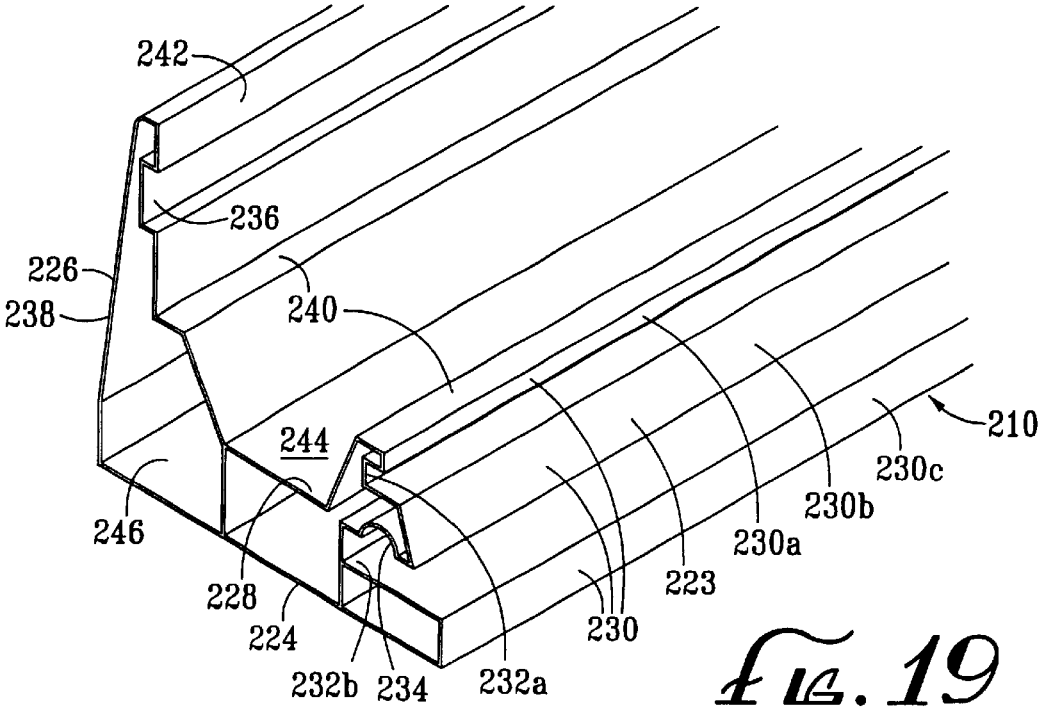

Turning to FIGS. 18–21, an alternative embodiment of a base connection system 200 is shown, that includes a base connector 210 and a base retaining clip 214. As best seen in FIG. 19, the base connector 210 is an elongate generally "L" shaped member having a lower portion 223, including a pair of substantially horizontal elongate rails 240, and a raised portion 226 defining inner and outer surfaces 242, 238. The elongate rails 240 are spaced apart from one another a predetermined distance corresponding to the thickness of a wall panel, i.e., such that when a wall panel is placed on the base connector 210 adjacent the inner surface 242, the wall panel rests on both elongate rails 240.

A trough 228 is provided between the elongate rails 240, thereby providing a passage 244, similar to the passage 144 described above. In addition, one or more additional substantially enclosed passages, such as the passage 245, may also be provided in the base connector 210 and/or base retaining clip 214. The inner surface 242 of the raised portion 126 includes an elongate slot 236 extending along the length of the base connector 210. Opposite the raised portion 226, the lower portion 223 includes a plurality of tongues 230*a*–230*c* separated by a pair of grooves 232*a*, 232*b*. One of the grooves 232*b* includes a generally hemispherical aperture 234 therein extending along the length of the base connector 210.

As shown in FIG. 20, the base retaining clip 214 is an elongate generally "L" shaped member including inner and outer surfaces 248, 246, an upper region 250 and a lower surface 252. The inner surface 248 includes an elongate slot 254, similar to the opposing elongate slot 236 in the base connector 210 (see FIG. 18). A pair of tongues 256*a*, 256*b* defining a groove 258 therebetween extend from the inner surface 248, the lower tongue 256 including a hemispherical aperture 260 therein, similar to the aperture 234 in the base connector 210.

As may be seen in FIG. 18, the tongues 230, 256 and grooves 232, 258 are configured to interlock, thereby connecting the base retaining clip 214 to the base connector 210 to provide a generally "U" shaped base channel member for securely receiving a wall panel (not shown in FIG. 18). When properly aligned, the apertures 234, 260 together define a substantially cylindrical channel through which a locking member may be received. The outer surfaces 238, 246 preferably provide a finished baseboard for the building structure, requiring no additional architectural finish. In addition, weather stripping or other sealant (not shown) may be provided in the seams, e.g., between the base connector and underlying substrate, the base connector and the base retaining clip, and/or the wall panels to substantially seal the base connection system 200, and thereby seal the interior of the building structure from exposure to the elements, as will be appreciated by those skilled in the art.

Turning to FIG. 21, the base connection system 200 is shown with a panel member 10 placed on the rails 240, and with the base retaining clip 214 attached to the base connector 210 and locked in place by a locking member 262. The panel member 10 includes a pair of elongate tabs or rails 212 that extend along lower portions of the inner and outer skins 14, 16. Preferably, the elongate tabs 212 are composite material molded directly onto the inner and outer skins 14, 16 and have a cross-section substantially similar to the elongate slots 236, 254. Alternatively, a plurality of spaced apart tabs (not shown) may be molded or otherwise provided along the inner and outer skins 14, 16 as long as they are properly aligned to be received in the elongate slots 236, 254. In a further alternative, a plurality of slots (not shown) may be provided along the base connector 210 and the base retaining clip 214 for receiving a plurality of corresponding tabs.

When the panel member 10 is properly placed on the rails 240, one of the tabs 212 may be received in the first elongate slot 236 in the base connector 210, and the other tab 212 may be received in the second elongate slot 254 when the base retaining clip 214 is connected to the base connector 210. The cooperating tabs 212 and slots 236, 254 may substantially secure the panel member 10 to the base connection system 200, and consequently to the underlying substrate to which the base connector 210 is attached.

Figure 9:
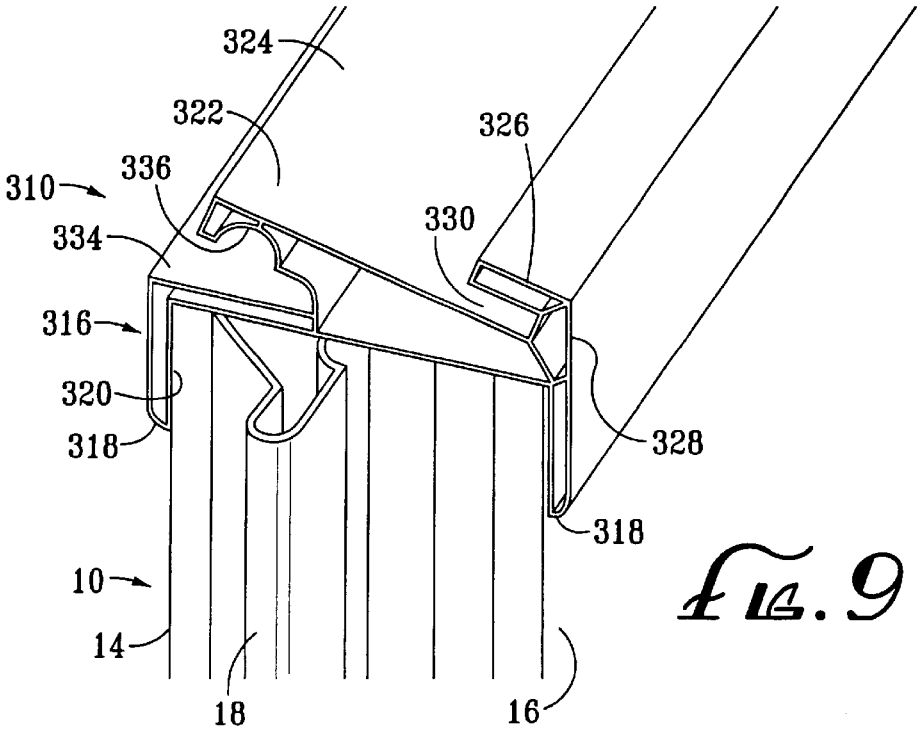
FIGS. 9–14 are perspective views of an upper edge of the composite panel of FIG. 1A, showing a roof connection system for connecting the composite panel to a composite roof panel.

Turning to FIGS. 9–14, a roof connection system 300 is shown for connecting one or more roof panels to one or more wall panels, including a cap member 310, a roof panel clip 312, and a cap retaining clip 314. As shown in FIG. 9, the cap member 310 is preferably formed form composite material, and includes an elongate generally "C" shaped channel member 316 having a pair of opposing legs 318 defining a channel 320 between them. An inclined portion 322 extends from the channel member 316 opposite the channel 320, the inclined portion 322 defining an upper surface 324. An elongate flange 326 extends along a lower edge 328 of the inclined portion 322, the elongate flange 326 defining a recess 330 therein. Opposite the elongate flange 326, the inclined portion 322 terminates in an upper portion 332, the upper portion 332 defining a recess 334 having a substantially hemispherical aperture 336 therein.

Figure 10:
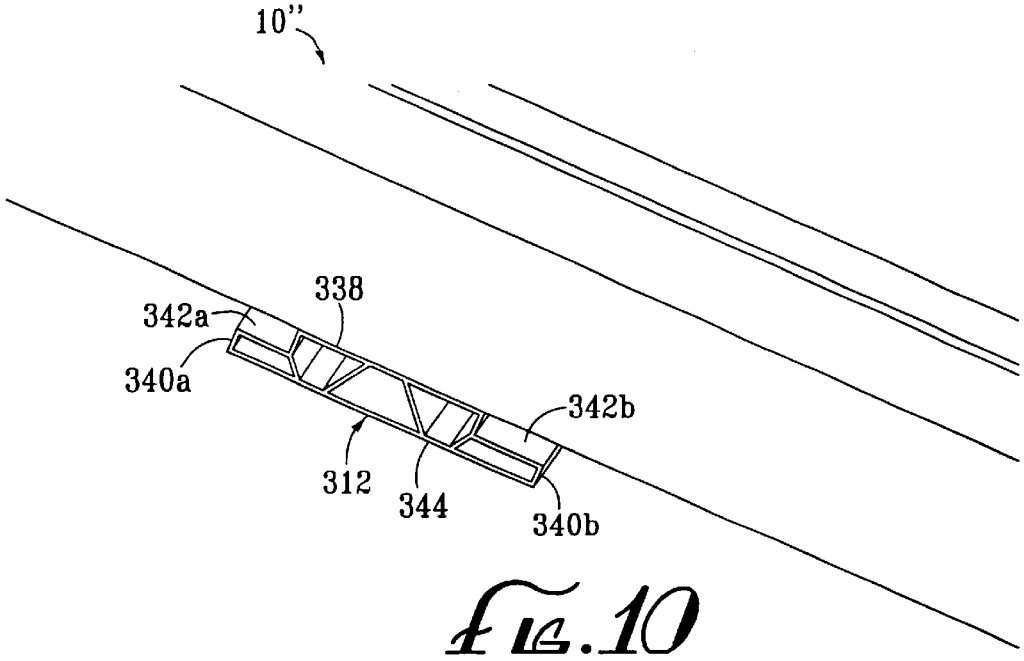
Figure 11:
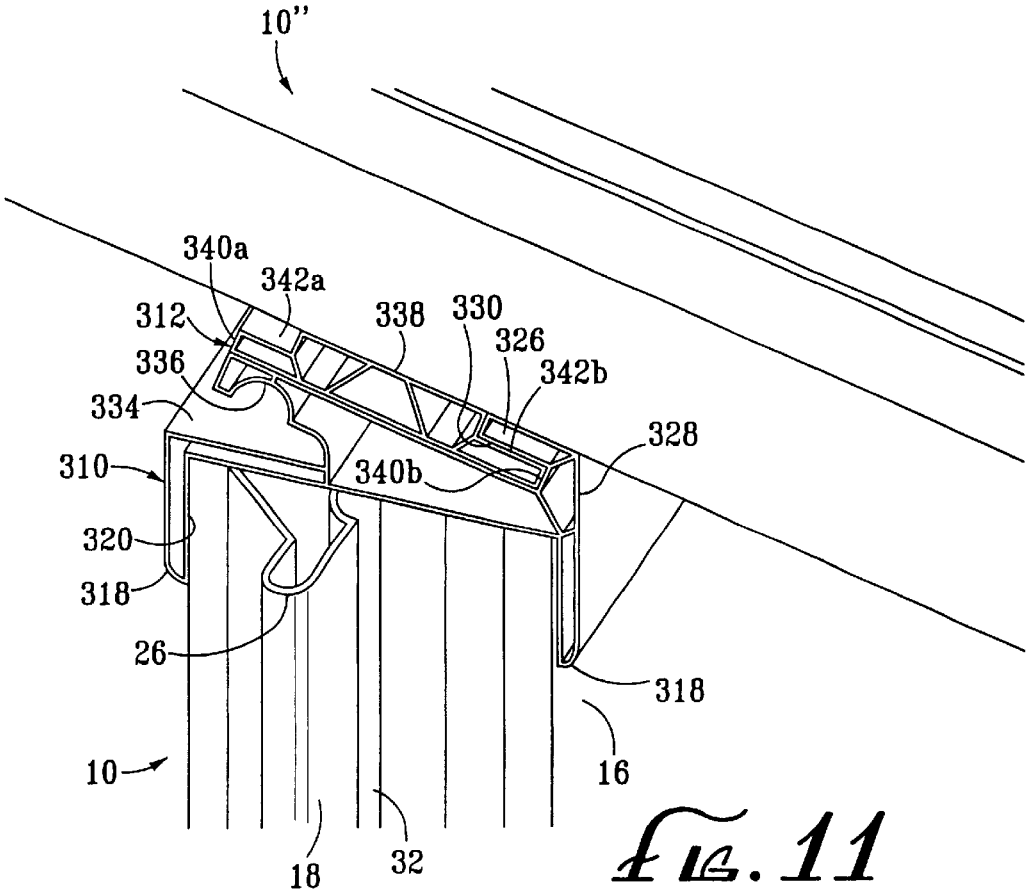

With reference to FIG. 10, the roof panel clip 312 is an elongate generally inverted "T" shaped member formed from composite material, and preferably bonded or integrally molded to a roof panel 10". The roof panel 10" is preferably a panel similar to the panel member 10 described above, which may be provided with specific width and length dimensions appropriate for use as a roof structure, as described further below. The roof panel clip 312 includes a base portion 338 and a pair of opposing flanges 340*a*, 340*b* defining the arms of the "T" and together defining a lower surface 344. When the base portion 338 is bonded to the roof panel 10", the flanges 340*a*, 340*b* define elongate recesses 342*a*, 342*b*. Preferably, the lower surface 344 has a width corresponding substantially to the upper surface 324 of the cap member 310, as shown in FIG. 11.

Figure 12:
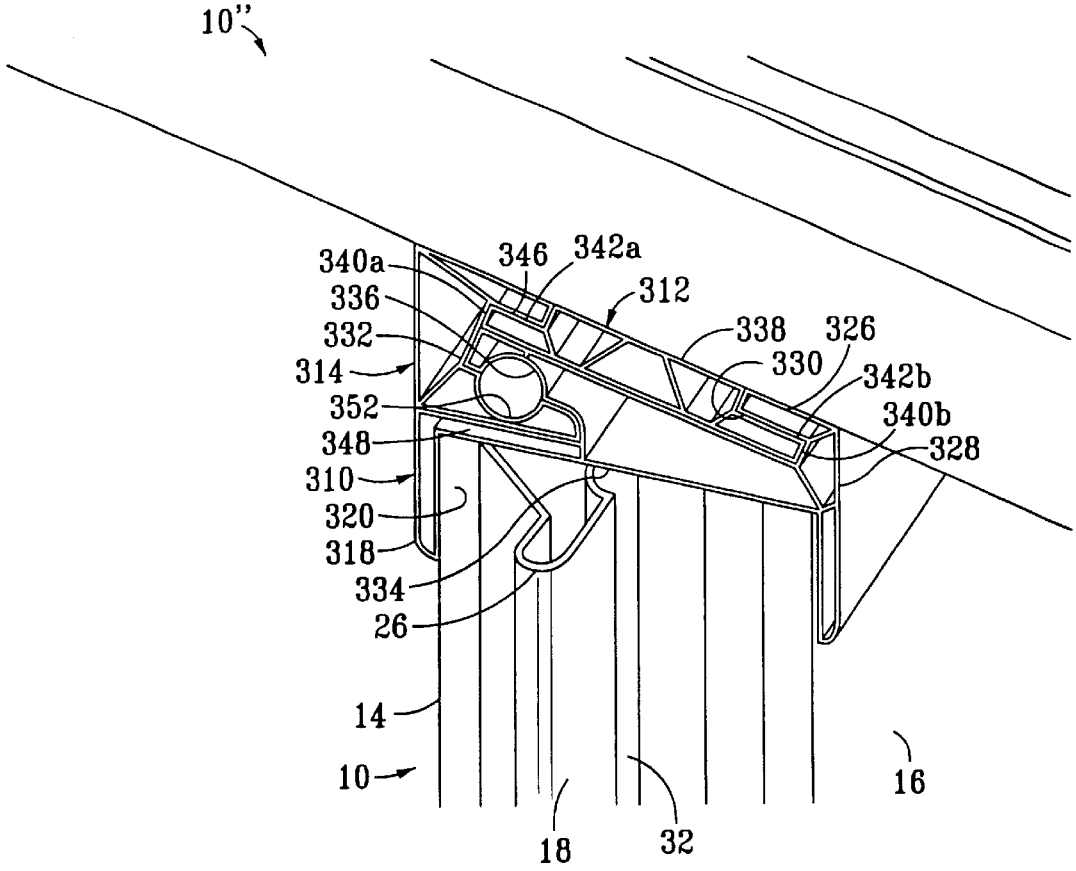

Turning to FIG. 12, the cap retaining clip 314 is an elongate generally "C" shaped member formed from composite material and including upper and lower flanges 346, 348 defining a channel 350 therebetween. The flanges 346, 348 are spaced apart from one another a predetermined distance, preferably such that the channel 350 has a width corresponding substantially to the combined thickness of the flange 340*a* on the roof panel clip 312 and the upper portion 332 of the cap member 310. The lower flange 348 includes a substantially hemispherical aperture 352 extending along the length of the channel 350.

During assembly of a building structure, one or more wall panels may be erected, for example, using one of the base connection systems described above. The wall panels, such as the panel member 10 shown in FIG. 9, may have a cap member 310 provided on their upper edges. Preferably, a cap member 310 is pre-assembled onto each individual panel member 10, e.g., during initial manufacturing of the panel member 10 or during assembly prior to delivery to the erection site. The cap member 310 may be formed in lengths corresponding to the width of the panel member 10 or may be cut from longer lengths. A bonding process, for example, using the resin-catalyst mixture described above, may be used to bond the cap member 310 to the panel member 10. Alternatively, the cap member 310 may be placed over a plurality of erected wall panels (not shown), and bonded in place.

A roof panel, such as the panel member 10" shown in FIG. 10, may then be placed substantially transversely over the panel member 10 defining the wall of the building structure. Preferably, the roof panel clip 312 is provided in individual lengths, or cut from longer lengths, corresponding to the width of the panel member 10" which are bonded across the width of the panel member 10" at a predetermined location.

As shown in FIG. 11, when the panel member 10" is placed over the panel member 10, the lower surface 338 of the roof panel clip 312 may abut the upper surface 324 of the cap member 310, and the flange 340*b* may be directed into the recess 330 defined by the flange 326. The cap retaining clip 314 may then be inserted over the upper portion 332 and flange 340*a* such that the upper and lower flanges 346, 348 of the cap retaining clip 314 are received in the recesses 342*a*, 334, respectively.

Figure 13:
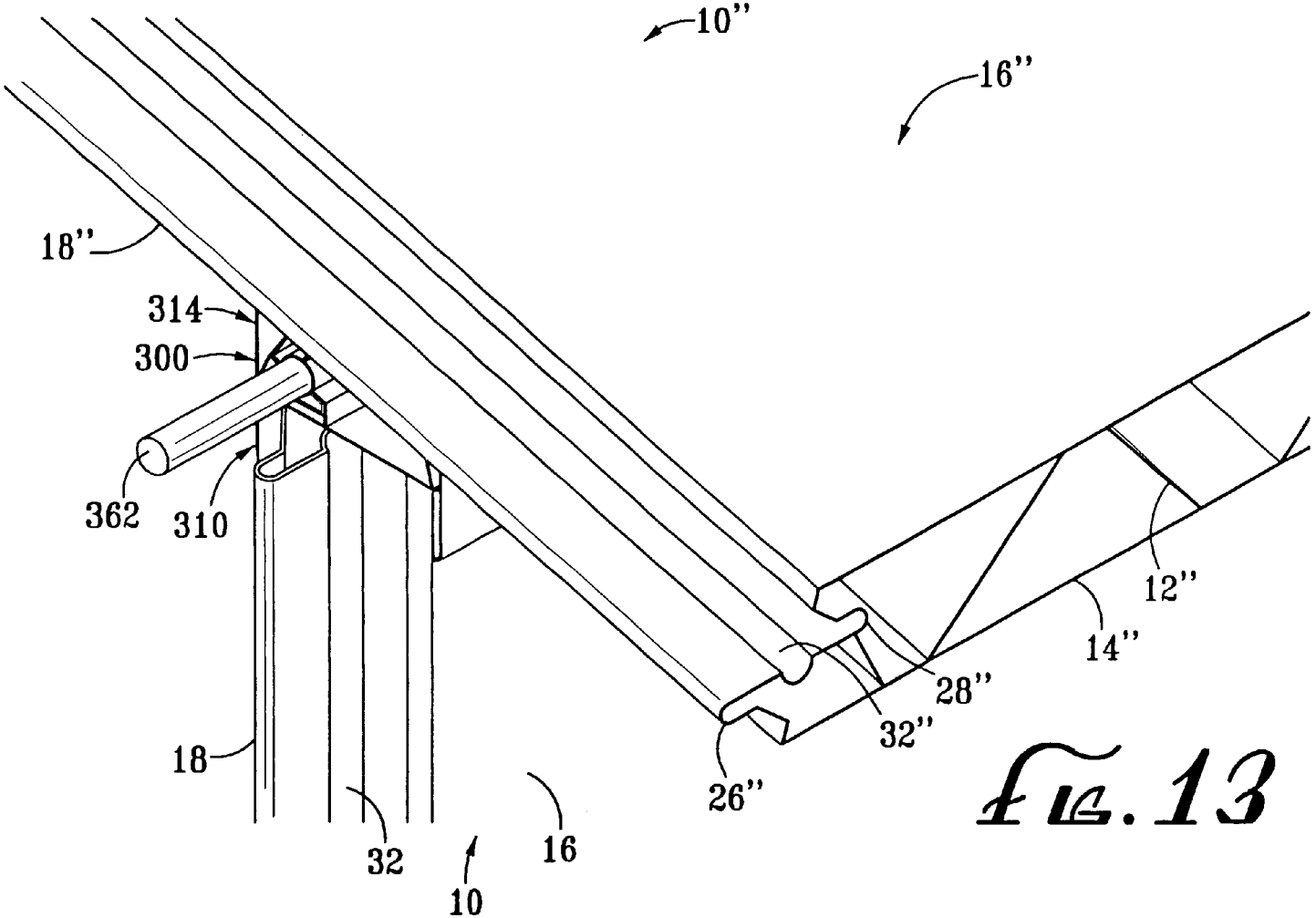
Figure 14:
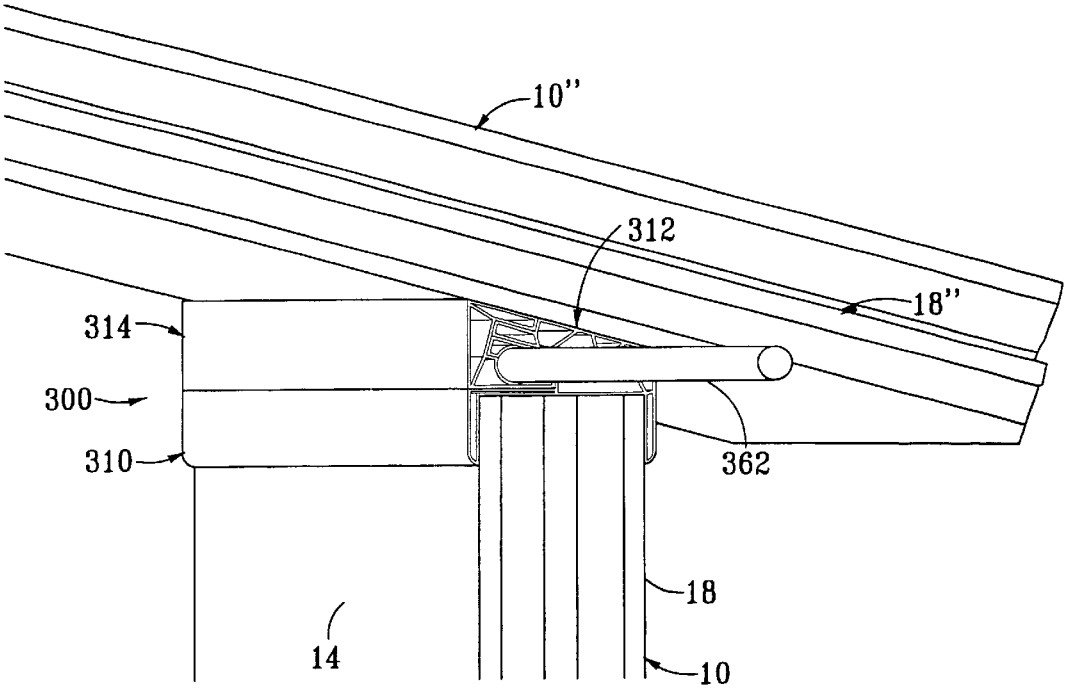

Preferably, when the cap retaining clip 314 is properly received on the cap member 310, the apertures 336, 352 then together define a generally cylindrical channel through which a locking member 362 may be received, as shown in FIGS. 13 and 14. Once the locking member 362 is received through the channel, the roof connection system 300 is substantially locked together, thereby securing a set of roof panels, such as panel member 10", to a set of wall panels, such as panel member 10, of the building structure. Further, because of the predetermined incline angle of the inclined portion 322 the roof panels may automatically be oriented with a desired roof pitch.

In a preferred form, as may be seen in FIG. 13, the panel members 10" provided for the roof panels of a building structure may be made similar to the panel members 10 provided for the wall panels. The panel member 10" may include an internal truss member 12" onto which inner and outer skins 14", 16" may be bonded. The outer skin 16" may be provided with a desired architectural finish, which may be molded directly into the outer skin 16", such as a ceramic or asphalt tile pattern.

The thickness of roof panels, such as panel member 10", may be set at a predetermined value, e.g., to provide a desired insulation value, with a standard thickness of about 4.5 inches, similar to the wall panels, being preferred. The length of the panel member 10" may be set by the demands of the building structure, e.g., the panel member 10" may extend from the peak of the roof to the outer wall panels, and possibly beyond, which may require the roof panels to be substantially longer than, e.g., up to twice as long as, corresponding wall panels. Because substantial lengths may be involved, the panel member 10" may be provided with a width substantially narrower than the width of the wall panels, e.g., to provide greater structural strength and/or to provide a more light-weight panel member 10", which may be handled and erected without the need for special lifting equipment. A panel member 10", with a width of not more than about 3 feet, and preferably with a width standardized at about 3 feet, which may weigh as little as about 135 pounds, is presently preferred.

Panel connectors 18" may be provided on each side edge of the panel member 10" for connecting adjacent roof panels to one another, as shown in FIG. 13. The upper edges (not shown) may be ramped to provide a peak for the roof or may be connected to a roof peak connector (not shown). The lower edges 15" may include a predetermined architectural finish, such as a flat end plate or a gutter (not shown), which may be bonded or otherwise attached to individual roof panels or along a plurality of erected roof panels.

Figure 15:
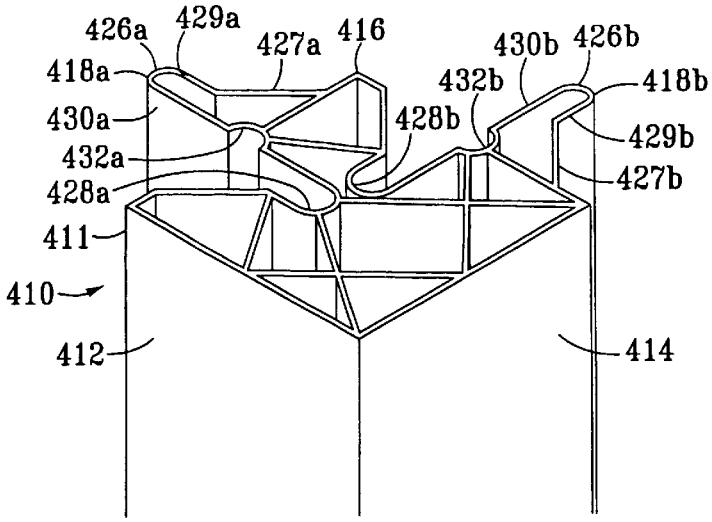
FIGS. 15–17 are perspective views of a corner connector for connecting two adjacent composite panels.

Turning to FIG. 15, a corner connector 410 is shown which has an elongate generally square shaped column portion 411 formed from composite material and a pair of panel connectors 418*a*, 418*b* integrally molded to the column portion 411. Preferably, the panel connectors 418*a*, 418*b* are oriented substantially perpendicularly to one another to generally define an "L" shape, and provide outer surfaces 412, 414. Each panel connector 418 includes a tongue 426 and groove 428 oriented adjacent to one another, thereby preferably defining an inside surface 430 having a generally hemispherical aperture 432 therein.

Figure 16:
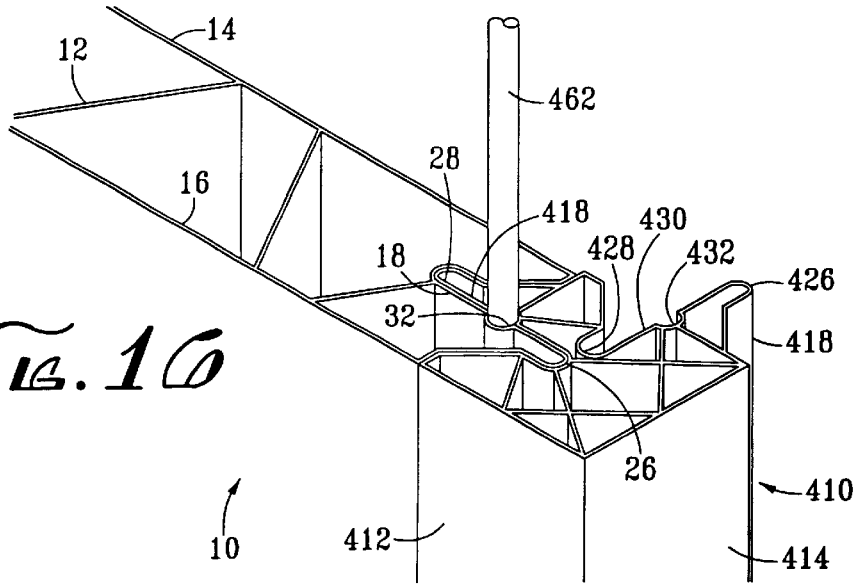
Figure 17:
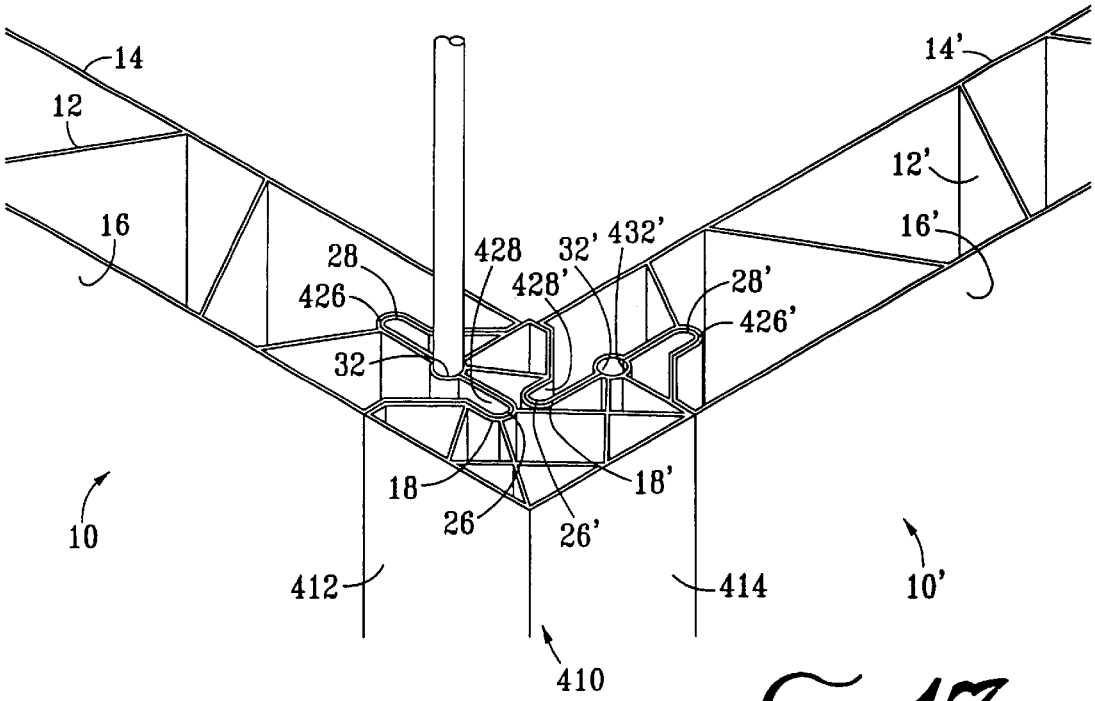

Preferably, the tongues 426 have a tapered base portion 427 and a rounded tip portion 429, and the grooves 428 have a similar configuration to provide a sliding interference fit that maximizes surface contact between the tongues and grooves on the panel members 10, 10' (FIG. 17) being connected to the comer connector 410. For example, as shown in FIG. 16, a first panel member 10 may be aligned with the comer connector 410 such that the outer skin 16 of the panel member is substantially planar with one of the outer surfaces 412 of the corner connector 410. The panel connectors 18, 418 may be interlocked, and a locking member 462 may be driven through the channels defined by the apertures 32, 432 to substantially secure the panel member 10 to the comer connector 410. Similarly, as shown in FIG. 17, a second panel member 10" may also be connected to the corner connector 410.

To substantially anchor the corner connector 410 and associated panel members 10, 10', a lower end of the locking members 462 may extend beyond the lower edge of the panel members and into a hole in the slab or substrate (not shown). The lower end may then be bonded within the holes, or alternatively, the lower end may be threaded and screwed into a similarly threaded insert embedded within the slab.

In addition, the corner connectors may have a length similar to the length of the panel members, and therefore may remain elevated above the slab after connection. This may provide access into the passages extending within the base connection system supporting each panel member, for example, to facilitate installation of utility accessories. When access is no longer needed, a composite cap (not shown) may be used to cover the exposed corner. Preferably, the composite cap includes two substantially perpendicular side portions, generally defining an "L" shape, that may be substantially flush with the outer surfaces of the base connection system and panels. The composite cap may also include an upper portion for abutting the bottom of the corner connector. The cap may be substantially retained in the comer simply by friction, by interlocking tabs and/or slots, or by bonding.

Other connector members (not shown) may also be provided similar in configuration to the corner connector 410, that may be extruded or otherwise molded from composite material. For example, a generally "V" shaped connector may be provided for connecting roof panels at the peak of a building structure, with the angle between the panel connectors corresponding substantially to the roof pitch. In a further alternative, a generally "T" shaped connector may be provided having three panel connectors, one at the base, and one at each arm of the "T." A "T" shaped connector may facilitate connection between outer wall panels of a building structure and an interior wall panel abutting against the outer wall panels. Alternatively, a modified "U" channel may be used to secure intersecting walls, for example, where an interior wall may be connected to an exterior wall of a structure.

As previously indicated, the components of the structural panel systems described herein are preferably formed from composite or "FRP" materials, i.e., from fiber materials impregnated in a resin. Generally, the fiber material may be formed from long fiber strands, woven cloth mat or other configurations of filaments made from generally inert materials, such as glass, carbon, graphite, boron, quartz and the like. The resin may be selected from a number of thermoset plastics, such as polyvinyl chloride (PVC) or PVC derivatives, thermoplastic materials, such as phenolics, polyesters, vinylesters, polypropylenes, epoxies, and polycarbonates, and the like. Ultraviolet inhibitors may be added, if desired, to all or selected components, such as exterior skins, to protect the components from damage due to exposure to sunlight.

Phenolic resins are presently preferred as they have a higher resistance to fire as compared to other resins, i.e., they have relatively low coefficients of flame spread and smoke generation during combustion, and may be formulated such that they will not support substantial combustion at all. Phenolic resins also do not include styrenes, which may provide an improved environment during manufacturing and/or pre-assembly of the panels over other resins. Phenolic resins, however, may be corrosive and consequently may require special protection of manufacturing equipment and/or panel components during manufacturing. In a preferred form of the present invention, fiberglass is impregnated within a phenolic resin in proportions of about 15–60% fiberglass by volume, and more preferably about 25–35% fiberglass.

Panel components, e.g., truss members and panel skins, are preferably formed by a pultrusion process during which fiber material is directed through a resin bath, preferably a phenolic, polyester or vinylester resin, and the resulting composite is pulled through a die where it is formed into a desired shape, and cured. A pultrusion process may allow the components to be manufactured on a continuous basis using a panel machine or impregnator, known to those skilled in the art. The composite material may be fed continuously through the die, and then cut into predetermined lengths. Because of the partial automation provided by pultrusion processes, high volume, high efficiency manufacturing may be obtained.

Alternatively, "open mold" wet lay-up methods may be used during which one or more of the components may be manufactured individually. This may reduce output volume, but may allow special textures, such as the architectural finishes described above, to be incorporated into finished components, such as the outer skins of the panels. For example, sheet molding compound or "pre-preg" may be used, in which resin is pre-applied to the fiber reinforcement and provided in an uncured sheet form. The sheet may be placed in a mold having a surface finish thereon, and heat and/or pressure may be applied to cure the material and mold the surface finish directly into the sheet. The panel components may be assembled at the manufacturing site into finished panels, although preferably, the components are shipped to the erection site or to an assembly site in relatively close proximity to the erection site. Special fixtures may be used to properly align and secure the components during assembly.

The spaces between the truss core and the skins may be filled with materials, for example, to provide increased insulation values, security, sound absorption, fire resistance and/or structural strength. For example, insulation may be placed between truss elements prior to bonding of the skins. More preferably, insulation materials may be injected or otherwise introduced into the interior panel spaces after assembly, for example, a foam polyurethane, such as polyisocynurate, or light-weight concrete. In a preferred form, recycled filler materials, and/or naturally-occurring materials available at or near the erection site may be used, such as rice hulls, coconut husks, sand or fly ash. The upper and/or lower edges of the panels may then be substantially sealed, e.g., by bonding connector clips to one or both edges. For roof panels, low density foams, such as polyester, polystyrene, or preferably polyisocynurate, may be used as insulating materials, which may, for example, provide an insulation value of about R30 for a panel about 4.5 inches thick.

Other accessories for the panel system, such as the various connection systems described above, may be manufactured using a pultrusion method, but preferably are made using an extrusion process. Although an extrusion process may be performed on phenolic resin composites, PVC or PVC derivative materials may be extruded more easily, and may be preferred for accessory components.

A significant advantage of composite panels, as compared to wood or other traditional materials, is that the composition of composite materials may be modified in a predetermined manner to optimize the structural characteristics of components or systems formed using them. For example, the fiber reinforcement content of the material may be increased to generally increase the strength of the resulting structure, particular arrangements of fibers may be selected to provide selected structural properties, and the like.

Another advantage of connection systems in accordance with the present invention is the substantial elimination of special tools and fasteners. Although bolts may be required to fasten base connection systems to the structural substrate of the building structure being erected, the connectors of the present system generally require only a single rod-like locking member to assemble each joint. Thus, the substantial volume of hardware generally required for erecting building structures, e.g., bolts, screws, nails, gaskets, and the like, may be substantially eliminated.

The interlocking connectors and single locking member may further augment the structural integrity of the resulting building structure, and allow rapid assembly, and optionally disassembly, of the building structure. Panels may be aligned, connectors interlocked, and a locking member driven through the resulting channel in the joint, preferably with no tools other than a mallet. Thus, unskilled labor may be used to erect a building structure built from systems in accordance with the present invention, without needing heavy equipment and special tools, thereby substantially reducing erection costs as compared to traditional building structures.

If additional structural strength is desired, the locking members in vertical joints, such as panel connections and comer connections may be directed through the base connection system into the substrate, e.g., into predetermined holes in the concrete slab of the structure. In addition, the upper end of such locking members may be directly attached to desired points on the roof panels, to further secure the roof of the structure. For example, the upper ends of particular locking members may extend above the wall panels, and the corresponding roof panels may have holes provided therethrough, e.g., drilled at the erection site or provided during initial manufacturing. The roof panels may be placed on the wall panels such that the upper end of the locking members extend through the holes. A mechanical connector may then be attached to the exposed upper end to secure the roof panels to the corresponding wall panels. In a preferred form, the upper end of the locking members may be threaded, and the mechanical connector may be a washer and nut that may be screwed onto the upper end until the washer substantially engages the roof panel. Further, the locking members in horizontal joints may also be anchored by extending them beyond the panels at the corners of the building structure, for example, using a mechanical connector, such as a bolt-washer assembly, to connect the locking member to the building foundation.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. A method for assembling a building structure from a plurality of panel members, each panel member comprising inner and outer skins comprising fiber-reinforced plastic, and having panel connectors comprising plastic extending along their side edges, the panel connectors having an inside face including a groove extending generally parallel to the skins of the respective panel members, the method comprising the steps of:

placing first and second panel members in a gene rally planar orientation with respect to one another;

interlocking the panel connectors of the first and second panel members such that the grooves of the panel connectors together define a channel extending between the first and second panel members;

inserting a locking member through the channel, thereby substantially locking the first and second panel members together;

attaching a composite base connection member to a substantially horizontal substrate, the base connection member including a pair of raised portions extending along its length; and engaging a lower edge of the first panel member with the raised portions to secure the first panel member in a substantially vertical orientation.

2. The method of claim 1, comprising the additional steps of:

attaching a composite base insert clip to the lower edge of the first panel member, the base insert clip including a pair of notched clip portions; and engaging notches on the raised portions of the base connection member with the notched clip portions.

3. The method of claim 2, wherein the base connection member comprises a base connector including a first raised portion, and a base retaining clip including a second raised portion.

4. The method of claim 3, comprising the additional steps of placing the lower edge of the first panel member on the first raised portion;

engaging the notches on the first raised portion with one of the notched clip portions on the first panel member;

attaching the base retaining clip to the base connector; and engaging the notches on the second raised portion with the other notched clip portion, thereby holding the first panel member substantially vertically.

5. The method of claim 4, wherein the base connector and the base retaining clip include grooves extending along their lengths, and wherein the method comprises the additional steps of:

aligning the base retaining clip with the base connector such that the grooves define a channel extending between the base retaining clip and the base connector; and inserting a locking member through the channel, thereby substantially locking the base retaining clip to the base connector.

6. The method of claim 1, wherein the raised portions define a channel therebetween, and the lower edge of the first panel is placed in the channel substantially securely between the raised portions.

7. The method of claim 6, wherein the base connection member comprises a base connector, including a first raised portion, and a base retaining clip including a second raised portion.

8. The method of claim 7, comprising the additional steps of:

placing the lower edge of the first panel member on the base connector with a first skin of the first panel member against the first raised portion; and attaching the base retaining clip to the base connector, thereby substantially engaging a second skin of the first panel member with the second raised portion.

9. The method of claim 8, wherein the raised portions and the first and second skins of the first panel member include cooperating tabs and slots for substantially securing the first panel member between the raised portions.

10. The method of claim 8, wherein the base connector and the base retaining clip include grooves extending along their lengths, and wherein the method comprises the additional steps of:

aligning the base retaining clip with the base connector such that the grooves define a channel extending between the base retaining clip and the base connector; and inserting a locking member through the channel, thereby substantially locking the base retaining clip to the base connector.

11. The method of claim 1, comprising the additional step of directing utility accessories along a passage defined by the base connector member.

12. A method for assembling a building structure from a plurality of panel members, each panel member comprising inner and outer skins comprising fiber-reinforced plastic, and having panel connectors comprising plastic extending along their side edges, the panel connectors having an inside face including a groove extending generally parallel to the skins of the respective panel members, the method comprising the steps of:

placing first and second panel members in a generally planar orientation with respect to one another;

interlocking the panel connectors of the first and second panel members such that the grooves of the panel connectors together define a channel extending between the first and second panel members;

inserting a locking member through the channel thereby substantially locking the first and second panel members together;

attaching a composite cap member to an upper edge of the first panel member; and attaching a third panel member to the cap member in a substantially transverse orientation with respect to the first panel member, the third panel member and cap member including a cooperating tab and recess.

13. The method of claim 12, wherein the cap member includes an inclined upper surface, and wherein the third panel member is attached to the upper surface to provide a desired roof grade.

14. The method of claim 12, comprising the additional step of attaching a composite cap retaining clip to the cap member to secure the third panel to the cap member.

15. The method of claim 14, wherein the cap member and the cap retain clip include grooves extending along their lengths and wherein the method comprises the additional steps of:

aligning the cap retaining clip with the cap member such that the grooves define a channel extending between the cap retaining clip and the cap member; and inserting a locking member through the channel thereby substantially locking the cap retaining clip to the cap member.

* * * * *